US009326643B2

(12) United States Patent
Xu et al.

(10) Patent No.: US 9,326,643 B2
(45) Date of Patent: May 3, 2016

(54) WALL-MOUNTABLE, HANDS-FREE, BACK-SCRUBBING APPARATUS

(71) Applicants: Tao Xu, Naperville, IL (US); Xiaojun Zhang, Shenzhen (CN); Hui Wang, Shenzhen (CN)

(72) Inventors: Tao Xu, Naperville, IL (US); Xiaojun Zhang, Shenzhen (CN); Hui Wang, Shenzhen (CN)

( * ) Notice: Subject to any disclaimer, the term of this patent is extended or adjusted under 35 U.S.C. 154(b) by 302 days.

(21) Appl. No.: 14/083,526

(22) Filed: Nov. 19, 2013

(65) Prior Publication Data

US 2015/0135425 A1 May 21, 2015

(51) Int. Cl.

| | |
|---|---|
| ***A47K 7/00*** | (2006.01) |
| ***A47K 7/02*** | (2006.01) |
| ***A47K 7/03*** | (2006.01) |

(52) U.S. Cl.

CPC .. *A47K 7/024* (2013.01); *A47K 7/03* (2013.01)

(58) Field of Classification Search

CPC . A47K 7/024; A47K 7/022; A61H 2201/081; A61H 7/002; A61H 2201/105; A46B 9/005; A46B 11/0062

USPC ..... 4/606; 15/104.92, 160, 210.1, 244.1, 15/244.3

See application file for complete search history.

(56) References Cited

U.S. PATENT DOCUMENTS

| | | | | | |
|---|---|---|---|---|---|
| 3,750,226 | A * | 8/1973 | Morgan | ..... | A47K 7/024 15/160 |
| 4,014,051 | A * | 3/1977 | Pettit | ..... | A47K 7/024 15/104.92 |
| 4,047,259 | A * | 9/1977 | Lotis | ..... | A47K 7/024 15/104.92 |

(Continued)

FOREIGN PATENT DOCUMENTS

| | | | | | |
|---|---|---|---|---|---|
| DE | 4307338 | A1 * | 9/1994 | ..... | A47K 7/024 |
| FR | 1229106 | A * | 9/1960 | ..... | A47K 7/024 |
| GB | 2219738 | A * | 12/1989 | ..... | A47K 7/024 |

*Primary Examiner* — Lauren Crane
*Assistant Examiner* — Erin Deery
(74) *Attorney, Agent, or Firm* — Christopher J. Scott

(57) ABSTRACT

A wall-mountable apparatus enables a user to scrub the user's back hands-free. The apparatus includes two primary features, namely, a slider plate and a back-engaging assembly. The slider plate includes laterally opposed plate-to-assembly engaging structures. The back-engaging assembly includes a plate-engaging interface structure, a bezel structure and a liquid material delivery assembly. The plate-engaging interface structure includes laterally-opposed plate-engaging structures. The laterally-opposed plate-engaging structures cooperate with the plate-to-assembly engaging structures for attaching the back-engaging assembly to the slider plate. The bezel structure includes a hemi-ovoidal outer surface, and an assembly-receiving inner surface. The liquid delivery apparatus is received adjacent the assembly-receiving surface and includes a liquid receptacle and liquid delivery elements. The delivery elements are in communication with the bezel structure for outletting liquid from the liquid receptacle to the outer surface. The back-engaging assembly is vertically adjustable relative to the wall-mountable slider plate.

20 Claims, 21 Drawing Sheets

(56) References Cited

U.S. PATENT DOCUMENTS

| | | | | | |
|---|---|---|---|---|---|
| 4,053,960 | A * | 10/1977 | Kingswell | A47K 7/03 | 15/104.92 |
| 4,696,068 | A | 9/1987 | Kenner | | |
| 4,699,127 | A * | 10/1987 | Schley | A47K 7/024 | 4/606 |
| 5,311,635 | A * | 5/1994 | Moore | A47K 7/024 | 15/210.1 |
| D374,362 | S * | 10/1996 | Miller | D6/540 | |
| 5,628,083 | A | 5/1997 | Hayes | | |
| 5,774,907 | A * | 7/1998 | Doggwiler | A47K 7/046 | 15/104.92 |
| 5,779,653 | A * | 7/1998 | Thompson | A47K 7/024 | 601/134 |
| 5,822,824 | A | 10/1998 | Dion | | |
| 6,370,722 | B1 | 4/2002 | Duckworth | | |
| 6,418,574 | B2 * | 7/2002 | McDowell | A47K 7/024 | 15/104.92 |
| 6,427,279 | B1 | 8/2002 | White, Jr. et al. | | |
| 6,647,564 | B1 | 11/2003 | Smith | | |
| 2006/0235345 | A1 | 10/2006 | Ivanov | | |
| 2009/0133205 | A1 | 5/2009 | Vaughan | | |

* cited by examiner

WALL-MOUNTABLE, HANDS-FREE, BACK-SCRUBBING APPARATUS

BACKGROUND OF THE INVENTION

1. Field of the Invention

The present invention generally relates to a bath instrument for enabling a user to scrub his or her back when taking shower. More particularly, the present invention is an apparatus that may be mounted to the wall of a shower stall and enables the user to scrub his or her back hands-free.

2. Brief Description of the Prior Art

U.S. Pat. No. 4,696,068 ('068 patent), issued to Kenner, discloses a Shower Wall and Bathtub Mounted Back Washer. The '068 patent describes a back washer and massager supported on a shower wall or bathtub and includes a pad of foam plastic with a waterproof cover and a rigid backing plate supported by a plurality of suction cups with a terry cloth or similar fabric cover mounted on the pad to enable easy removal for laundering and the like with the cover for the pad including a pocket on the interior surface thereof to receive soap positioned in a net bag so that a person taking a shower or bath can position their back or any other inaccessible area of their body against the surface of the terry cloth or other fabric cover and by moving the body area engaged with the cover provide a washing or massaging function on the surface area of the body.

U.S. Pat. No. 5,628,083 ('083 patent), issued to Hayes, discloses a Back Cleanser and Applicator. The '083 patent describes a device to clean or apply a balm to a person's back comprising a rigid base panel fastened to a wall with suction cups on a shower wall. The device includes a foam panel covered PVC sheet which in turn is covered with a plastic netting to reduce the sliding friction with an overall cover. The device may include a spinal scrubber between the cover and the netting of vertical row of semi-rigid block members attached to a panel all encased in foam and sealed film. Foam balm applicators may be attached on the cover either in netting pockets or with cotton balls attached on the foam applicators.

U.S. Pat. No. 5,822,824 ('824 patent), issued to Dion, discloses a Mountable Washing Device. The '824 patent describes a washing device generally comprising a cloth support section and a mounting section attached to the cloth support section. The support section is preferably a foam pad having an attachment surface and a curved, cloth support surface. The mounting section includes a mounting surface and an attachment surface. The mounting surface comprises a plurality of suction cups and gripper ribs for retaining a wash cloth. The attachment surface is connected to the attachment surface of the pad, preferably by a hot-melt adhesive, to assemble the washing device. The assembled washing device is secured to a wall or other surface by the suction cups. A wash cloth is then placed on the support surface of the support pad and secured by pressing its edges between the gripper ribs and the surface to which the washing device is mounted.

U.S. Pat. No. 6,370,722 ('722 patent), issued to Duckworth, discloses a Wall-Mounted Back Scrubbing and Massaging Apparatus. The ;722 patent describes an apparatus having a wall mounting plate which is bonded to a rubber sheet having a plurality of suction cups, thereby allowing the wall mounting plate to be removably attachable to a wall surface. A sponge mounting box is mounted on the wall mounting plate by a lip. Opposite the lip, the sponge mounting box provides a base and a peripheral edge, which together form a sponge mounting surface. In a first embodiment, the base and the peripheral edge removably engage a sponge.

A plurality of outwardly extending fingers integral with the base, penetrate the sponge, further securing the sponge onto the base. The sponge is thus supported in spaced relationship with respect to the wall surface by the sponge mounting box so as to be in a position for convenient scrubbing of a person's skin when brought into contact with the sponge. In a second embodiment, the mounting box further includes a cover which frictionally engages the sponge mounting box, clamping a flexible lateral apron portion of a rectangular cloth, holding the cloth over the base. The cover and the sponge mounting box further provide drain apertures to allow water to drain from the apparatus.

U.S. Pat. No. 6,427,279 ('279 patent), issued to White, Jr. et al., discloses a Back Washing Device. The '279 patent describes a back washing device for scrubbing the back of a user. The back washing device includes a housing having a bottom wall, a top wall, a back wall, pair of lateral side walls and a front wall such that a lumen is defined in the housing. The front wall has a plurality of apertures therein. A securing device removably secures the housing to the wall.

A scrubbing member is securely attached to and generally covers an outer surface of the front wall. A container, having liquid soap therein, is positioned in the lumen. A hose member is fluidly coupled to the container and abuts an inside surface of the front wall. The hose member has a plurality of apertures therein. A pumping device pumps the liquid soap through the hose member so that the liquid soap enters the scrubbing member. The pumping device is securely attached to the container and extends outward of the housing through the top wall.

U.S. Pat. No. 6,647,564 ('564 patent), issued to Smith, discloses a Back Scrubber. The '564 patent describes a wall-mountable back scrubber comprising a rectangular base unit with adapter mounts and suction cups attached to the rear surface, slots with adjacent tabs in the front surface, and a compartment and soap dish in the top, along with a brush unit with adapter mounts attached to the rear surface, wherein the adapter mounts attached to the brush unit are configured to fit within the slots in the rectangular base unit and be held in place by the tabs. The back scrubber has particular utility in connection with scrubbing with a soothing and massaging effect.

United States Patent Application Publication No. 2006/0235345, authored by Ivanov, describes a back scrubbing device for use without hands installable in baths and/or fitness centers as well as in sport clubs are similar facilities. The device allows the application of a detergent thereon and cleaning while massaging the body. The applied massaging pressure can be controlled individually by the pressure the user applies against the device. The device comprises a three-dimensional main body with upper and lower plane surfaces, a flat back with furrows (ridges or grooves for dropping off water) and a convex or double convex front side having protrusions, the device further comprises connecting elements (tubular guide) for adjustably connecting it to a vertical rod or bar and fixing means for fixing it to different positions along the rod.

United States Patent Application Publication No. 2009/0133205, authored by Vaughan, et al., describes a back scrubbing device for mounting on a wall including a base, a platform, a hinged frame and a latching means for securing a scrubbing material on the platform within the frame. The device consists of a layered base and a hinged frame. A platform is attached to the external surface of the base. Within the hinged frame are frame elements which are generally centered over the platform. Along one edge of the hinged frame are hinges which connect the hinged frame to the base. Along the opposite edge is a securing mechanism, preferably a latch.

As may be understood from a consideration of the foregoing, the prior art has shown a number of wall-mountable back-scrubbing devices or instruments for enabling users to scrub users' back hands-free. It will be further understood, however, from a review of the foregoing, and the field of back-scrubbing apparatus art in general that the prior art perceives a need for a wall-mountable, hands-free back-scrubbing apparatus substantially as summarized hereinafter.

SUMMARY OF THE INVENTION

The present invention provides an instrument or apparatus that provides a user with certain means to scrub the user's back hands-free when showering. Liquid material such as body wash or soap material can be selectively output from the apparatus by manually pressing a button (and liquid delivery means) incorporated into the apparatus. The button of the apparatus is also removable so as to enable the user to refill the apparatus with liquid material when the liquid material becomes depleted.

The apparatus includes vertical adjustment means or a mechanism for allowing user's of varying heights to selectively change the vertical position of the back-engaging assembly relative to a slider plate that may be affixed to a wall within the shower stall or room. A bath towel or cloth may be outfitted upon the back-engaging assembly of the apparatus so as to provide the user with a better shower experience. The bath towel or cloth outfittable upon the back-engaging assembly may be selectively removed and laundered as needed.

The back-engaging assembly of the apparatus comprises a unique ergonomic, hemi-ovoidal, back-engaging shape for enhancing scrubbing contact with the user's back. The slider plate of the apparatus may be adhesively attached to the shower stall wall via double-sided adhesive strips as preferably exemplified by adhesive strips sold under the registered brands 3M® and COMMAND® by the 3M Company, a Delaware corporation with current business address of 2501 Hudson Road, St. Paul, Minn., 55144. The user may also shift the mounting position by pulling down the strips until they are separated from the shower stall wall.

The wall-mountable, hands-free, back-scrubbing apparatus or shower board system according to the present invention preferably comprises two primary functional components, namely, a liquid flow or delivery system and a height adjustment system. The liquid flow or delivery system according to the present invention is concealed within the back-engaging assembly within a main body cavity. A user may thus manually press the combination button-cap of the liquid delivery means or system and liquid material such as body wash or soap will flow out from certain section apertures, holes, or outlets formed in the hemi-ovoidal back-engaging scrubber structure of the back-engaging assembly.

The vertical adjustment means or height adjustment system according to the present invention operates by providing a hand-grippable lower area of the back-engaging assembly, which the user may manually pull. By so pulling or directing force thereagainst, the product will release from an otherwise locked state, and pivot about upwardly-located, coaxially aligned pivot pins which pins help attach the back-engaging assembly to the slider plate. Resilient tabs temporarily lock the back-engaging assembly to the slider plate, and the tabs are temporarily actuated when the user unlocks the apparatus for vertical adjustment.

During the unlocking movement, the user may perceive an audible "pa" sound, whereafter the user can adjust the height within an upper and lower limit of the apparatus. When the proper vertical height is achieved, the user may re-pivot the back-engaging assembly of the apparatus about the pivot axis extending through the coaxially aligned pivot pins, pushing or directing forces against the bottom of the scrubber structure until the resilient tabs formed upon the back-engaging assembly re-engage a guide-locking rib formed upon the slider plate. Once the device is vertically positioned and re-locked, it is ready for scrubbing use.

As indicated, the height adjustment system includes two primary parts, namely the slider plate and the back-engaging assembly. The posterior or rear side of the slider plate may be outfitted with double-sided adhesive means, and the anterior side can be regarded as support base for resisting pressure/force directed thereagainst via the back-engaging assembly as a user leans on the back-engaging assembly. Further, during vertical adjustment operations, the back-engaging assembly "slides" or vertically adjusts thereupon.

The laterally opposed sides of the slider plate each preferably comprise a rib guide way and a slider groove or pin-receiving groove area. The rib guide ways not only help to constrain horizontal movement, but also provide the primary structure for engaging the resilient tabs for providing the "pa" sound signifying when the apparatus is in either a locked or unlocked state. With regard to the pin-receiving grooves, certain further rib structures are located at the top ends thereof. Together with the bottom walls of the grooves, the groove ribs provide stop structure for limiting the highest and lowest point vertical displacements of the back-engaging assembly relative the slider plate.

The slider plate may be further outfitted with certain means for enhancing or controlling the vertical adjustment mechanism. In this regard, a slider block may be formed on each laterally opposed side of the slider plate, which slider blocks are received in block-receiving grooves formed on the back-engaging assembly. The block-receiving grooves have a width greater than the width of the slider blocks for enabling a controlled degree of pivotal rotation about the pivot axis extending through the pivot pins.

A rack of teeth formed on the rear or posterior surface of the back-engaging assembly cooperate with a set of teeth formed on the front or anterior surface of the slider plate. Together, the opposed teeth cooperate to fix the back-engaging assembly relative to the slider plate as well as provide support in rubbing force directions. Each tooth has a maximum thickness, which maximum thickness provides the minimum step advance for vertical adjustment.

As indicated the two pivot points or pins outfitted upon the back-engaging assembly provide the axis of rotation center, and slide or are guided within the pin-receiving grooves of the slider plate. To ensure proper alignment between the back-engaging assembly and the slider plate, half cylinder bosses are formed upon the back-engaging assembly tangent to anterior slider flat surface, and basically function to transfer pressure from user's back to the slider plate and shower wall and help prevent damage to the pivot pins under excessive forces. Ribs formed between the bosses and the pins help to reduce lateral gaps between the slide plate and the back-engaging assembly and resist laterally directed forces at the upper half of the apparatus.

An aperture formed at the bottom of the back-engaging assembly provides a drain hole for outletting liquid material that may enter the primary cavity of the back-engaging assembly. The liquid delivery system located within the primary cavity comprises certain liquid delivery conduit.

When a user presses the combination button-cap, a piston shaft is triggered and drives a piston to compress liquid material received in a liquid-retaining cavity. Liquid material in said cavity then flows out of the cavity under pressure, and is divided laterally into two laterally opposed conduit, which laterally opposed conduit connect the scrubber structure liquid outlets to the liquid delivery system.

The liquid material delivery assembly further comprises two valves, namely a check-valve and a silicon valve. Liquid material is prevented from reverse flow into the cavity via the check-valve. When the liquid material exits the liquid outlets formed in the scrubber structure, the liquid material can be utilized by the user to clean the user's back in cooperation with the bath towel cover.

When the user releases the force on the button cap, a compressed spring will provide push force to restore parts to original positions. A cross rib formed on the piston shaft provides certain balance to the spring force by engaging an inner wall of the primary liquid receptacle.

During restorative operations, the liquid material in the laterally opposed conduit is prevented from re-entering the liquid-retaining cavity due to the silicon valve. The check-valve, meanwhile allows liquid material to flow into said cavity from the primary liquid receptacle container, thereby readying the system for the next cycle.

BRIEF DESCRIPTION OF THE DRAWINGS

Other features of our invention will become more evident from a consideration of the following brief descriptions of illustrations of the subject invention.

DETAILED DESCRIPTION OF THE PREFERRED EMBODIMENT

Figure 1:
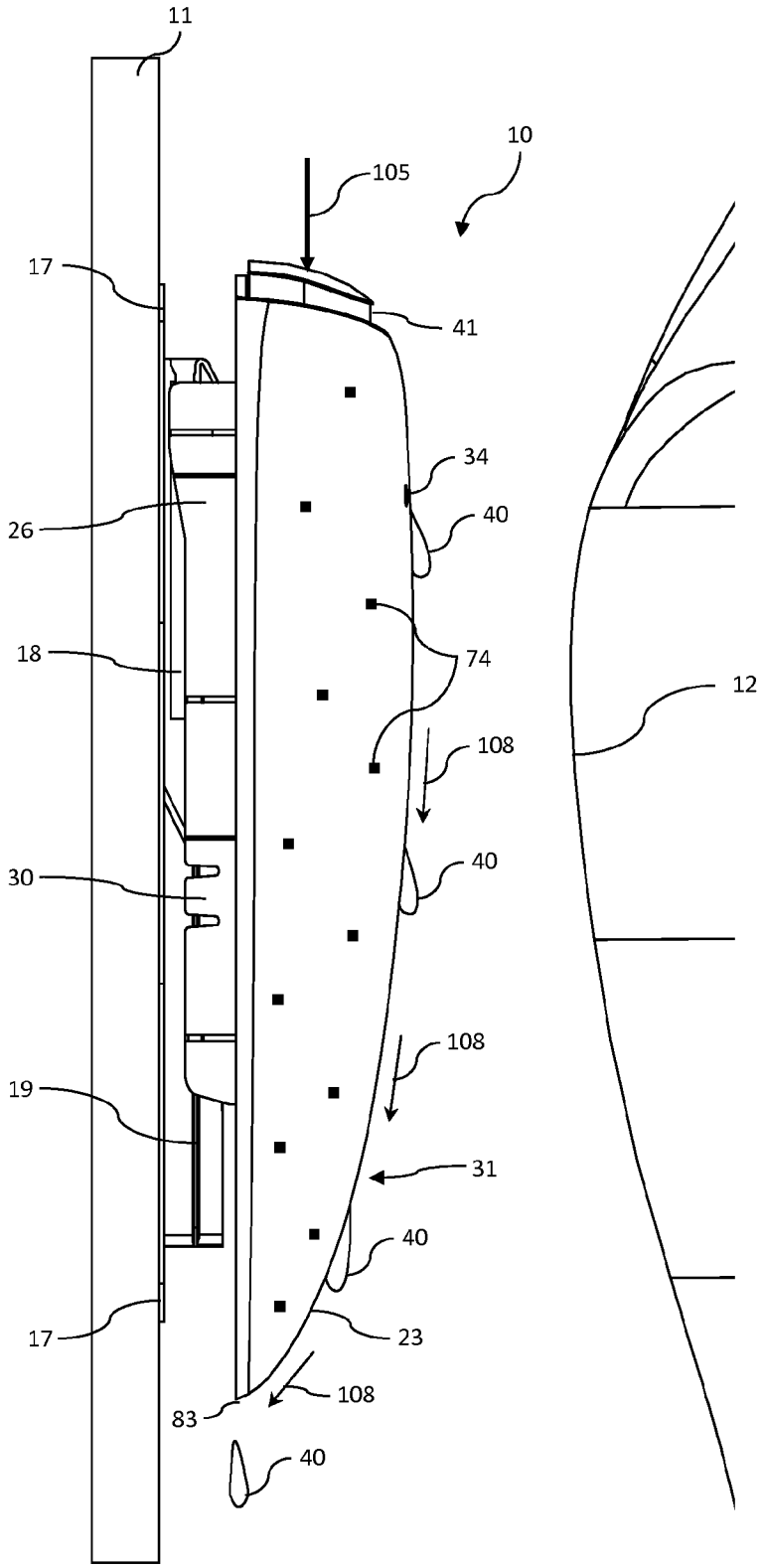
FIG. 1 is a lateral view of a preferred embodiment of the wall-mountable back-scrubbing apparatus according to the present invention shown mounted to a fragmentary wall and juxtaposed adjacent a fragmentary back of a user, the apparatus being shown in a fully elevated, closed state.

Referring now to the drawings with more specificity, the present invention preferably provides an apparatus 10 mountable to a wall 11 of a shower stall for enabling a user to scrub the user's back 12 without use of the user's hands or for enabling hands-free back-scrubbing. To achieve this primary function, the apparatus 10 according to the present invention preferably comprises a wall-mountable slider plate as at 13 and a main body assembly or back-engaging assembly as at 14.

The wall-mountable slider plate 13 comprises a wall-engaging posterior side as at 15, an assembly-engaging anterior side as at 16, and laterally opposed plate-to-assembly slider-locking engagement structures. The wall-engaging posterior side 15 is preferably outfittable with certain plate-to-wall fastening means as may be exemplified by adhesive fastening means 17. In this regard, it is contemplated that the preferred adhesive fastening means 17 may be exemplified by double-sided adhesive strips sold under the registered brands 3M® and COMMAND® by the 3M Company, a Delaware corporation with current business address of 2501 Hudson Road, St. Paul, Minn., 55144. Accordingly, the apparatus 10 may be adhesively fastened to the wall 11 by four 3M® COMMAND® brand adhesive strips at the four corners of the slide plate 13.

The laterally opposed plate-to-assembly engaging structures formed on the slider plate 13 each preferably comprise laterally opposed (a) laterally-located assembly-engaging structures and (b) anteriorly-located assembly-engaging structures. The laterally-located assembly-engaging structures preferably comprise upper pin-receiving grooves as at 18; laterally extending lower rib guides as at 19, and laterally extending block structures as at 20. The anteriorly-located assembly-engaging structures preferably comprise forwardly extending teeth as at 21. The teeth 21 extend forwardly adjacent the laterally extending lower rib guides 19.

Figure 6:
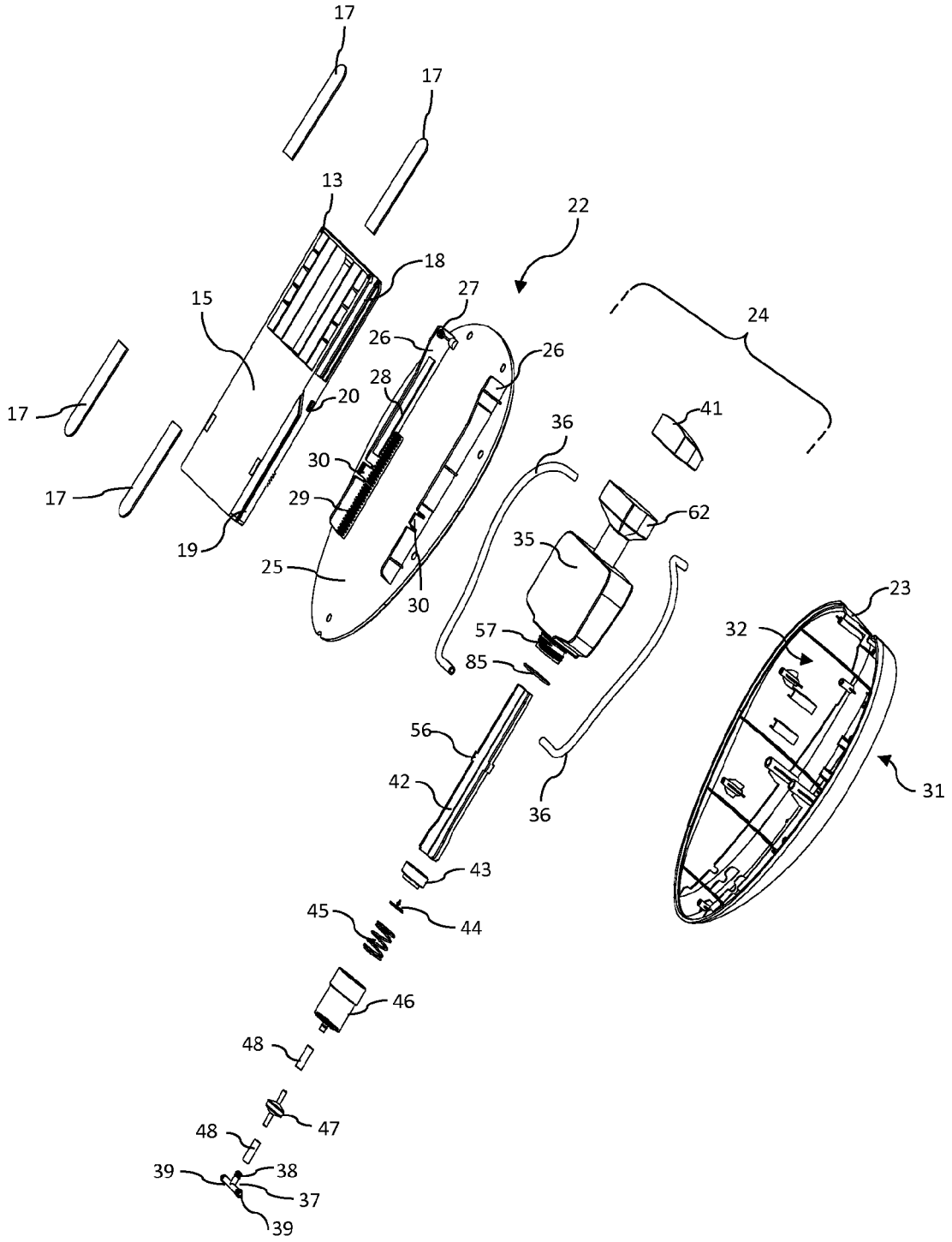
FIG. 6 is a back or posterior exploded perspective view of a preferred embodiment of the wall-mountable back-scrubbing apparatus according to the present invention, the back-engaging assembly being shown exploded from the slider plate, and the fluid delivery system being exploded from the back-engaging assembly.
Figure 6A:
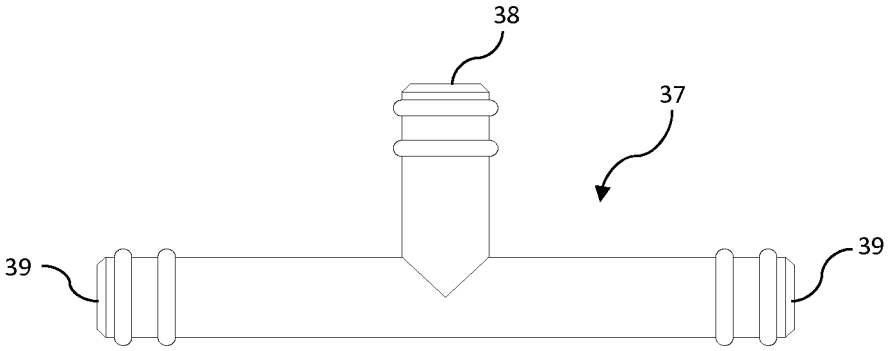
FIG. 6A is an enlarged front view of a T-junction conduit element according to present invention.

The main body or back-engaging assembly 14 preferably comprises a plate-engaging posterior interface structure as at 22, a back-engaging anterior (and especially-contoured) scrubber structure as at 23, and a liquid (e.g. soap) material delivery assembly as generally referenced at 24 in FIG. 6. The plate-engaging posterior interface structure 22 preferably comprises a backing or plate section as at 25 and laterally-opposed, rearwardly-extending plate-engaging structures as at 26.

The laterally-opposed plate-engaging structures 26 have a uniform distance therebetween slightly greater than the general width of the slider plate 13. Each plate-engaging structure 26 preferably comprises an upper medially extending pivot pin as at 27; a block-receiving groove as at 28; lower, rearwardly-extending teeth 29; and a resilient chamfered snap or tab structure as at 30. Note that the groove 28 has a certain groove width, which groove width is roughly thrice the block width of the block structures 20.

Figure 10:
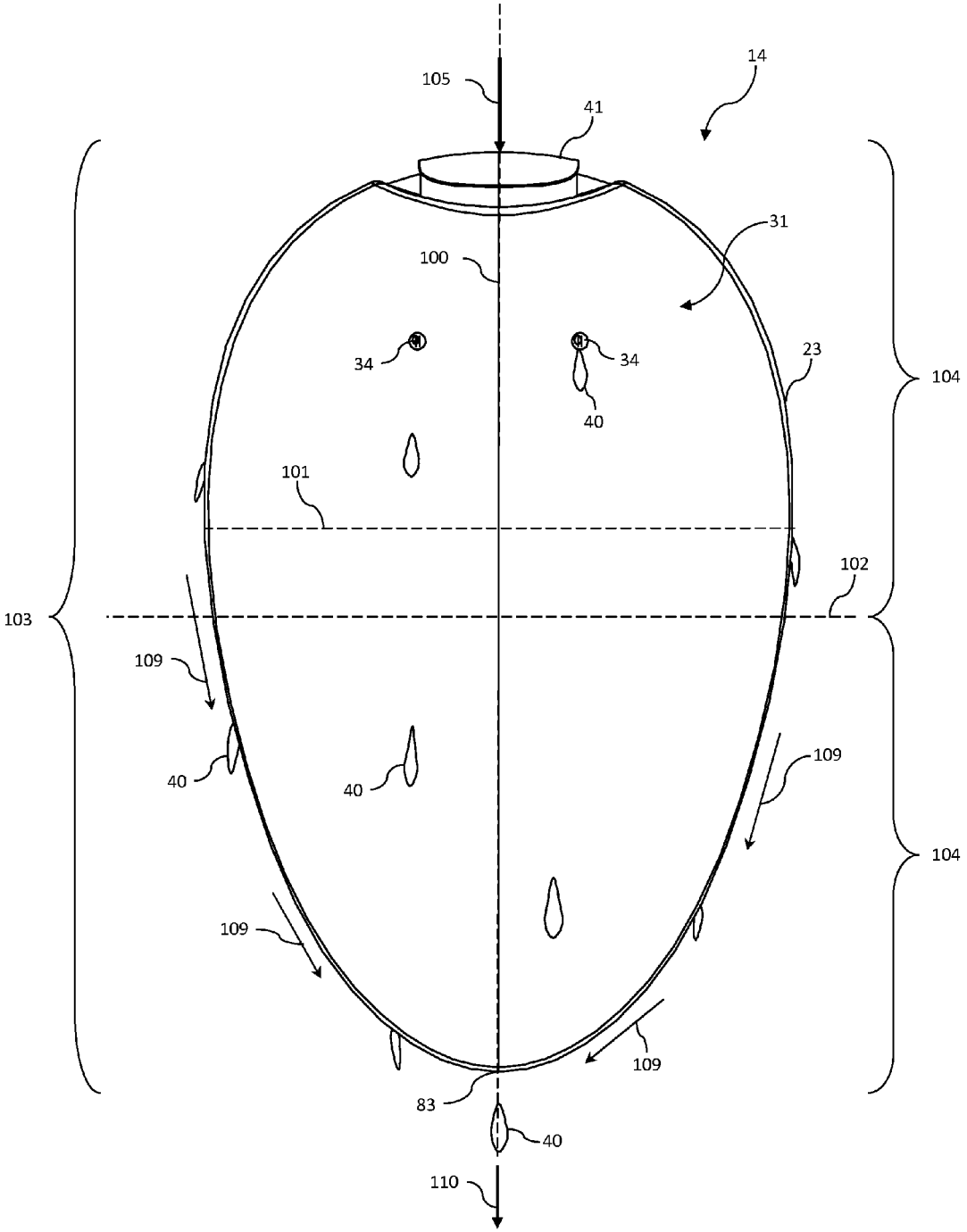
FIG. 10 is an anterior or frontal view of the back-engaging assembly of the wall-mountable back-scrubbing apparatus according to the present invention.

The especially contoured scrubber structure 23 preferably comprises a certain ovoidal (or egg-shaped) height as at 103 in FIG. 10; a hemi-ovoidal or egg-shaped outer surface or shape as at 31 and an assembly-receiving/housing inner surface or construction as at 32. The hemi-ovoidal outer surface 31 is believed central to the practice of the present invention and consists of a major axis as at 100 and a minor axis as at 101. Referencing FIGS. 1-3, it may be gleaned that the preferred transverse AND longitudinal cross-sectional shapes of the surfacing 31 is D-shaped or bow-shaped having a planar posterior portion and an arcuate anterior portion in two dimensions for enhanced ergonomic contact with the user's back as generally depicted in FIG. 3.

The major axis as at 100 is the sole axis of symmetry defining laterally opposed mirror-reflective, identical left and right hemi-ovoidal sections as at 33. The minor axis 101 is preferably located upwardly of a transverse scrubber plane 102 intersecting the ovoidal height 103 into equal upper and lower distances 104. The hemi-ovoidal sections 33 each preferably comprises a section aperture or liquid outlet 34 formed through the inner surface 32 and outer surface 31 preferably upwardly of the minor axis 101.

The liquid delivery apparatus or assembly 24 is receivable/housable within cavity 70 or adjacent the assembly-receiving surface 32 and preferably comprises a liquid receptacle 35, and certain liquid delivery means for delivering liquid from the liquid receptacle to the section apertures or outlets 34. The liquid deliver means may preferably include certain conduit for delivering liquid material 40 such as body wash or soap to the section apertures or outlets 34.

The conduit preferably comprises laterally opposed liquid delivery conduit as at 36, and a T-junction liquid delivery conduit 37 in communication with the plunger means extending through the liquid receptacle 35. The T-junction liquid delivery conduit 37 has a single liquid inlet 38 and laterally opposed conduit-engaging liquid outlets 39. The laterally opposed liquid delivery conduit 36 extend from the conduit-engaging liquid outlets 39 to the section apertures 34 for outletting liquid material 40 from the liquid receptacle 35 to the outer surface 31 when the user depresses (as at vector 105) a manually operable button 41 formed in connection with the fluid delivery means comprising certain plunger means.

The liquid delivery apparatus or assembly 24 inclusive of the receptacle 35 and fluid delivery means may be preferably exemplified by a number of components. Referencing FIG. 6, the fluid delivery apparatus comprises from top to bottom a manually depressable button 41, a liquid receptacle 35, laterally extending liquid delivery conduit 36, an O-ring 85, a piston shaft 42, a piston 43, a check valve 44, a return spring 45, a piston-receiving, cavity-forming structure 46, a valve assembly 47, two short conduit extensions 48, and T-junction liquid delivery conduit 37. The fluid delivery means or assembly may thus be said to preferably comprise the button 41, the piston shaft 42, the piston 43, check valve 44, return spring 45, piston-receiving structure 46, and valve assembly 47.

Referencing FIG. 13, and FIGS. 13A-13D, the reader will note an exploded view and supplemental alternative views of certain components. The piston shaft 42 is preferably designed with a transverse cross shape as at 49 so that the liquid material (such as body wash or soap) has sufficient volumetric space to flow into the piston cavity 50 thereby further enabling the user to fill the liquid receptacle 35 more quickly. The piston 43 may preferably comprise certain apertures 51 for letting liquid material 40 to flow more voluminously and/or rapidly into the cavity 50.

The transversely cross cut feature 64 of the piston shaft 42 is used to fix the piston 43 for enabling ease of assembly. The check valve 44 operates to control or govern liquid material 40 flow into the cavity 50 as the user manually depresses and releases (as at force vector 105) the button cap or button 41. The projection 52 of the check valve 44 enhances assembly of the check valve 44 to the piston 43.

Comparatively referencing FIGS. 11-13D, FIG. 11 depicts a back view of liquid flow system or liquid delivery apparatus or assembly 24. Almost all of the components of the liquid delivery apparatus or assembly 24 mount on or at the back or inner surfacing 32 of the scrubber structure 23 within the cavity 70. The short pipe or liquid delivery conduit 48 and the laterally opposed liquid delivery conduit 36 are interconnected via the three-pipe or T-junction liquid delivery conduit 37. Liquid material 40 such as body wash or soap will flow out from bottom to top as arrows 106 depict in FIG. 11.

Figure 12:
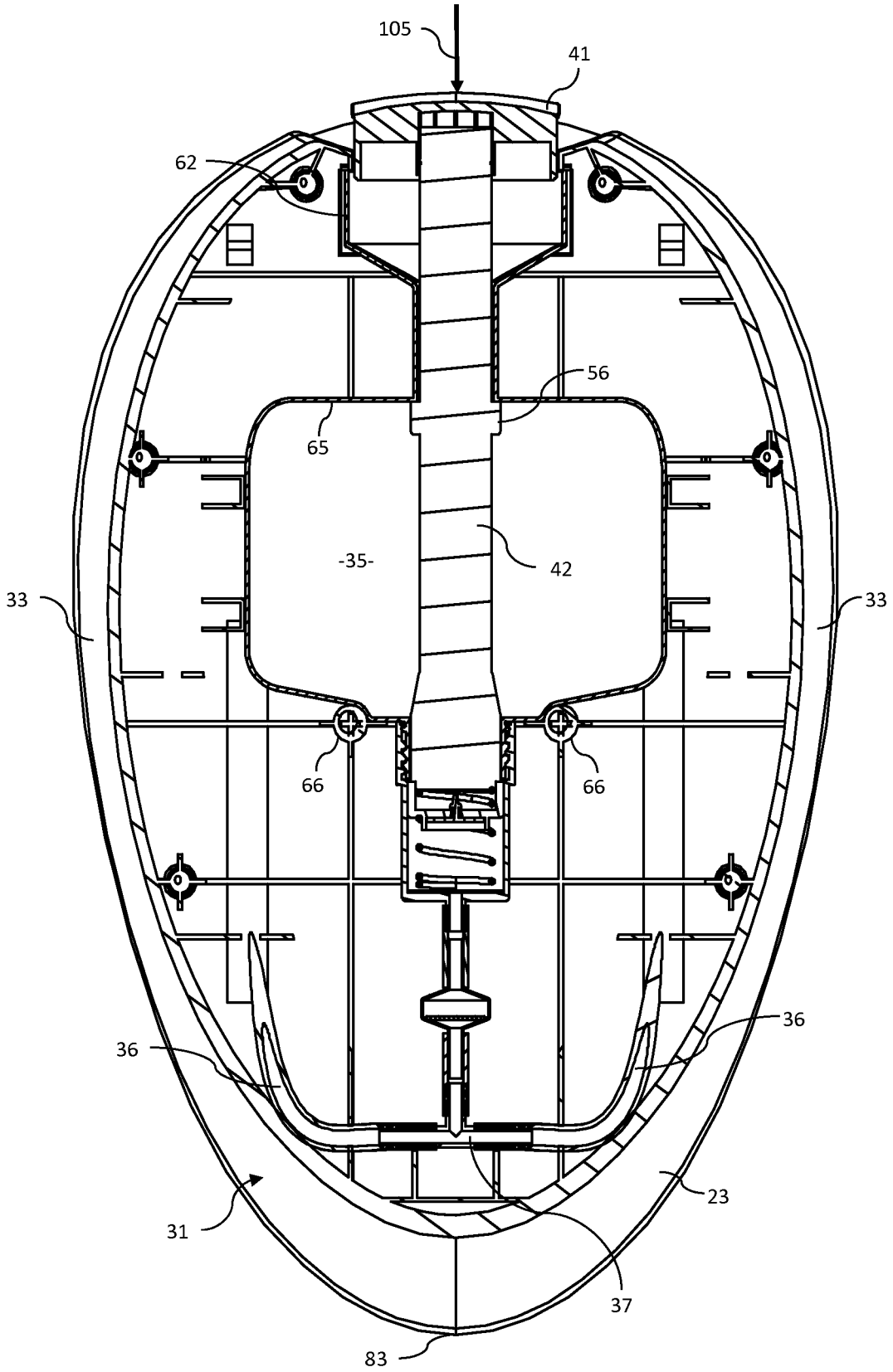
FIG. 12 is a sagittal longitudinal cross-sectional view of the back-engaging assembly of the wall-mountable back-scrubbing apparatus according to the present invention showing further elements of the fluid delivery system of the apparatus.
Figure 12A:
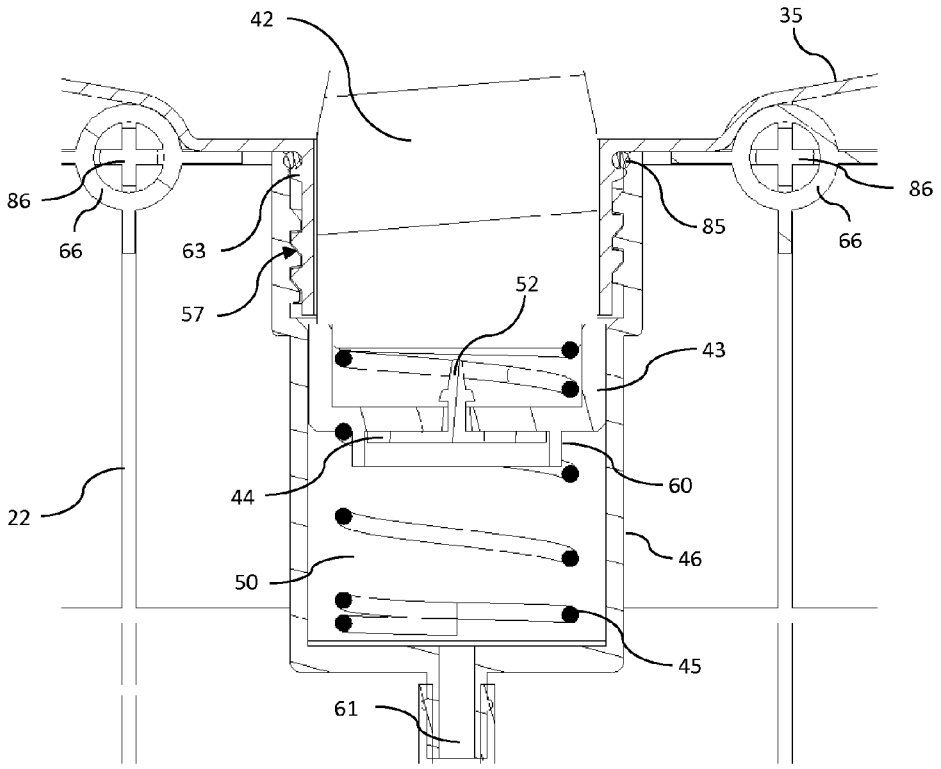
FIG. 12A is an enlarged fragmentary sectional view of the piston-cavity site of the fluid delivery system otherwise depicted in FIG. 12.
Figure 12B:
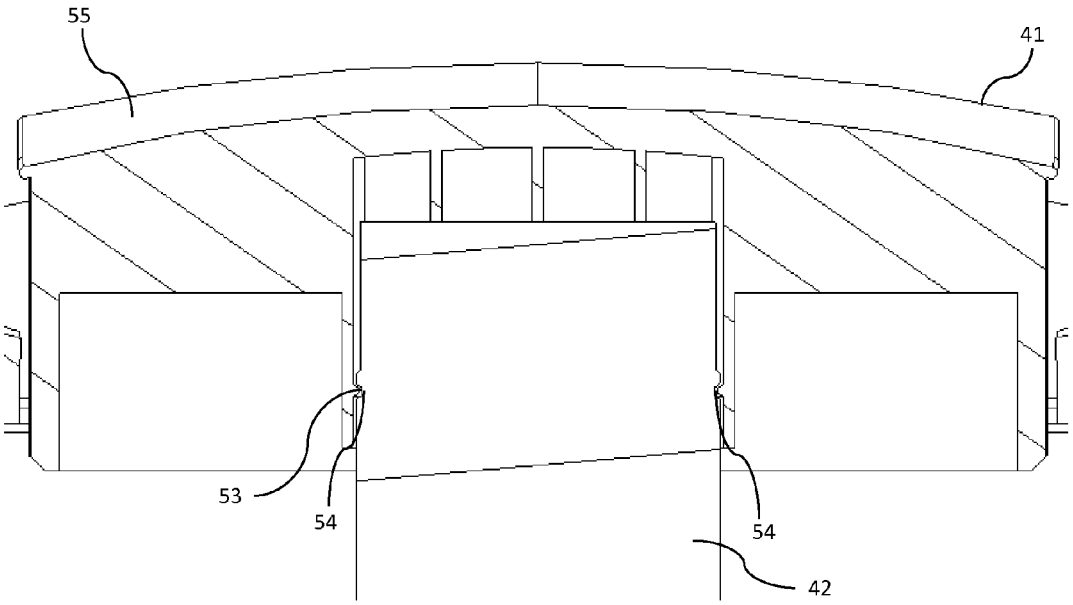
FIG. 12B is an enlarged fragmentary sectional view of the button-cap site of the fluid delivery system otherwise depicted in FIG. 12.
Figure 13:
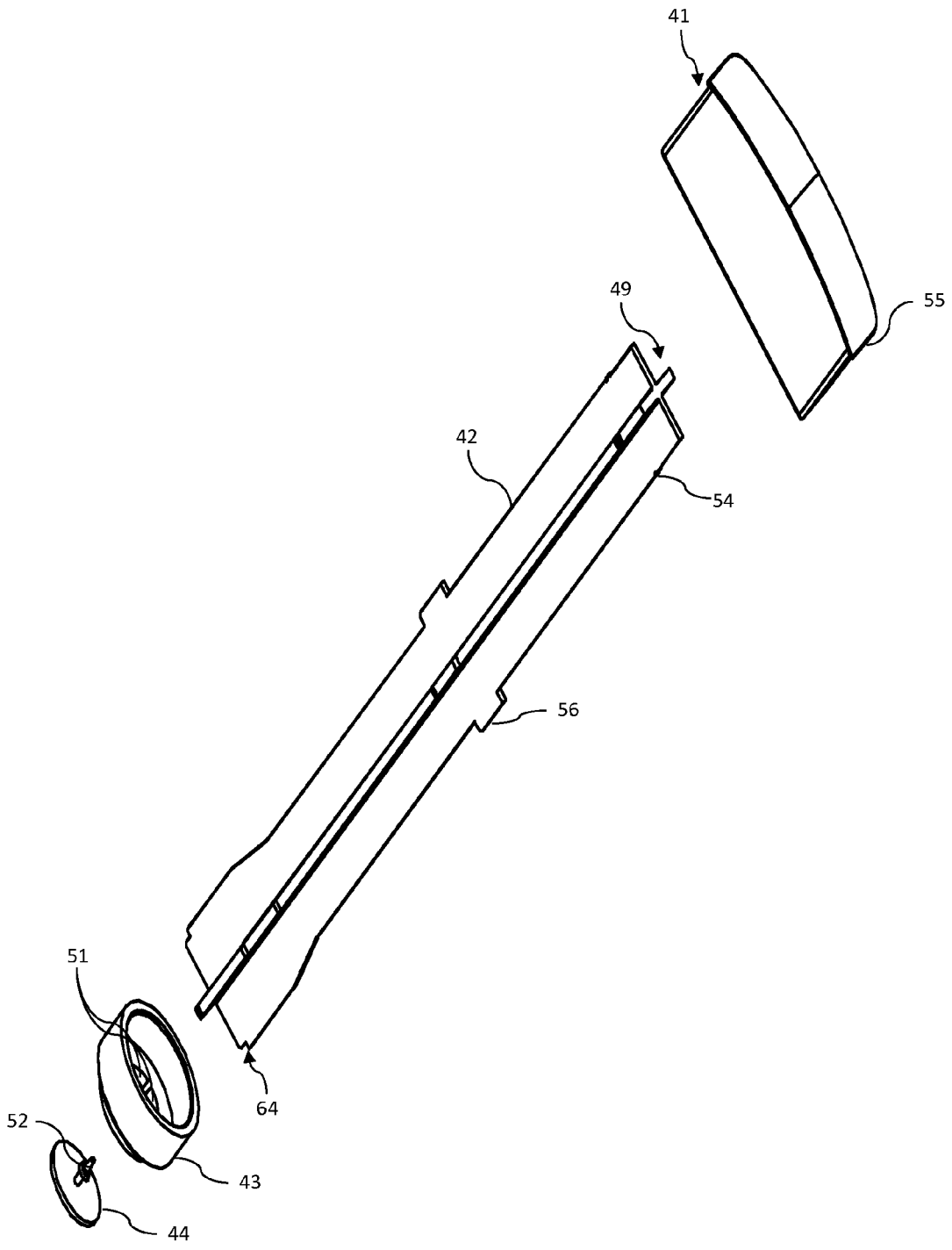
FIG. 13 is an exploded perspective view of certain components of the fluid delivery system of the wall-mountable back-scrubbing apparatus according to the present invention, including from top-to-bottom a button cap, a piston shaft, a piston, and a check valve.
Figure 13A:
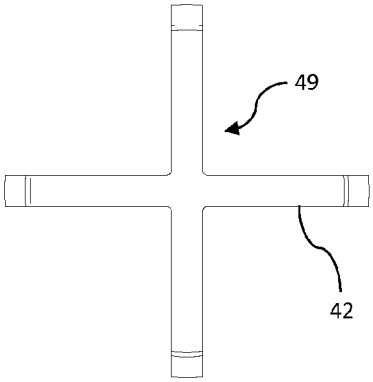
FIG. 13A is an enlarged transverse cross-section view of the piston shaft according to the present invention.
Figure 13B:
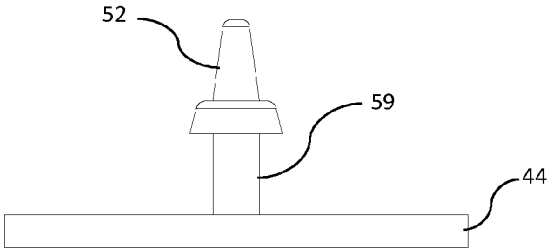
FIG. 13B is an enlarged side or lateral edge view of the check valve according to the present invention.
Figure 13C:
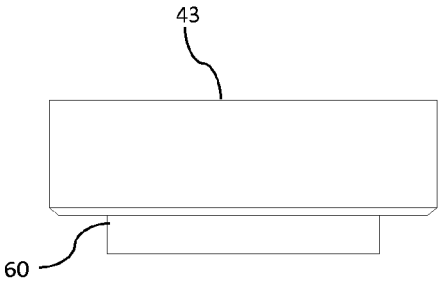
FIG. 13C is an enlarged side or lateral edge view of the piston according to the present invention.
Figure 13D:
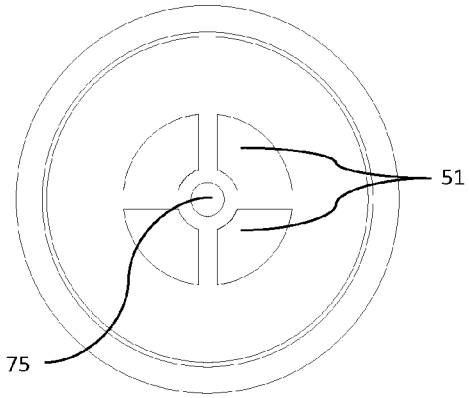
FIG. 13D is an enlarged axial view of the piston according to the present invention.
Figure 14:
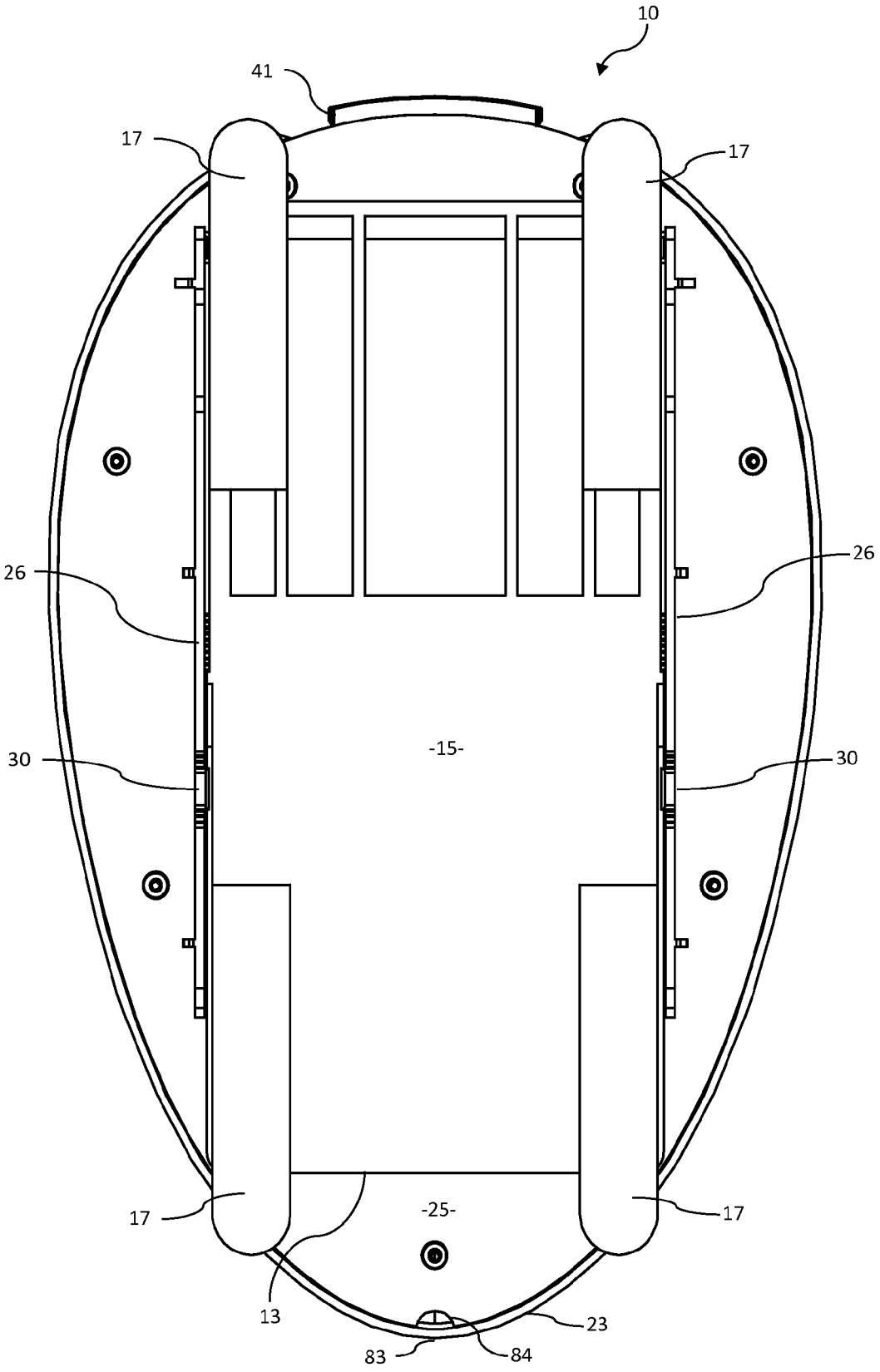
FIG. 14 is a back or posterior view of a preferred embodiment of the wall-mountable back-scrubbing apparatus according to the present invention, the apparatus being shown in a fully elevated state with adhesive strips attached to the wall-engaging surface.
Figure 15:
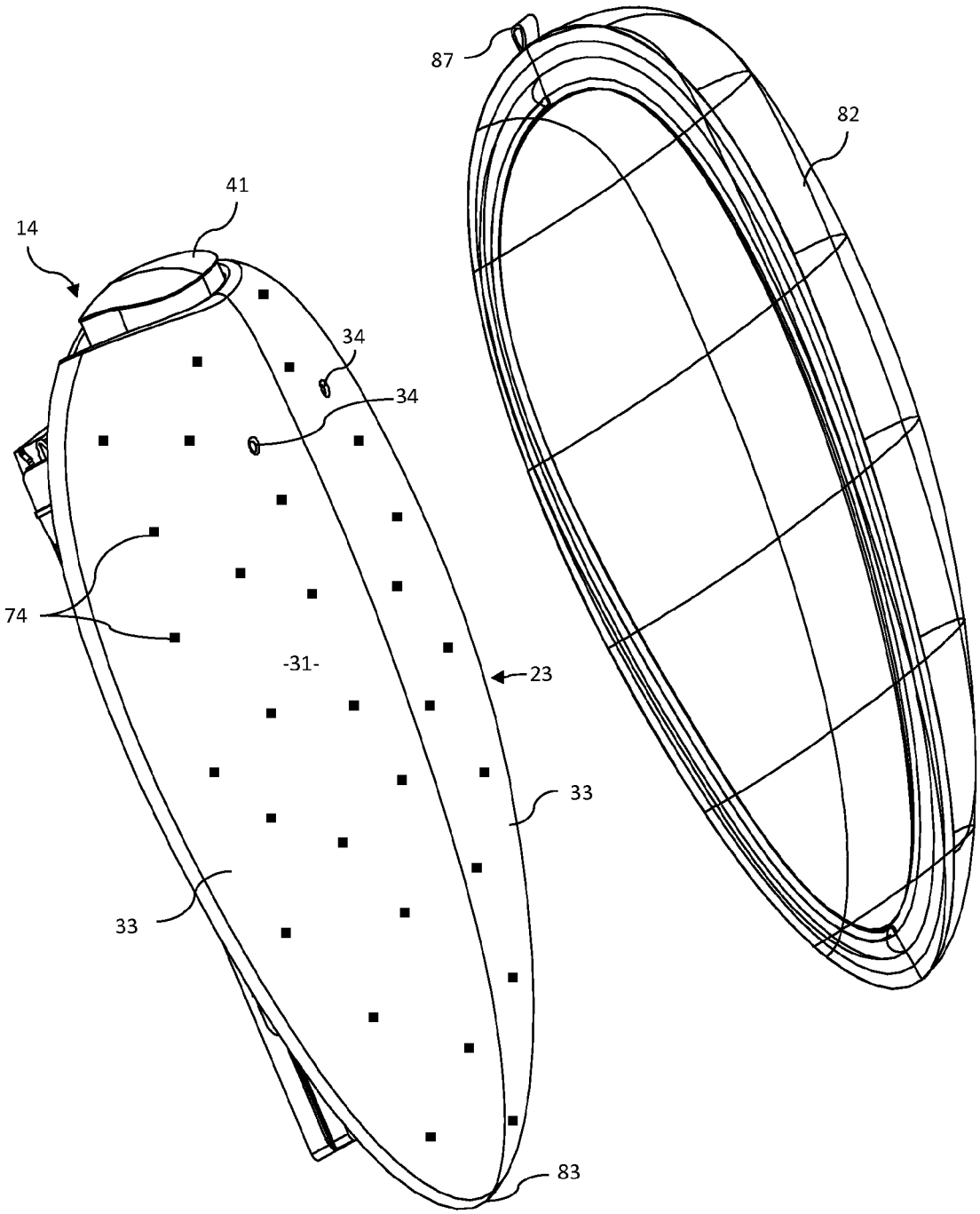
FIG. 15 is an anterior or frontal exploded perspective view of the back-engaging assembly and wash cloth cover of the wall-mountable back-scrubbing apparatus according to the present invention.

FIG. 12 depicts an anterior center cross-sectional view of assembly 24, and FIG. 12A and FIG. 12B are enlarged, fragmentary detailed views of cavity section from FIG. 12. The button cap 41 seats on the top of piston shaft 42. A round ring rib 53 of the button cap 41 cooperably fits in concave or notched area 54 of the piston shaft 42 with interference so that the button cap 41 will not become detached from the piston shaft 42. The exposed upper outer portion 55 around the button cap 41 essentially provides a handle area to enable a user to manually remove the button cap 41 from the piston shaft 42. The exposed upper outer portion 55 further functions to help cover the gap between surrounding parts.

The cross ribbing 56 on piston shaft 42 provide stop structure against the upper inner surfacing 65 of the liquid receptacle 35 thereby resisting the spring force and controlling the vertical position of the piston shaft 42. The piston-receiving structure 46 mounts to the liquid receptacle 35 via threaded engagement as at 57. The check valve 44 seats on or attaches to the piston 43 through an aperture 75 formed therein via the projection/protrusion 52, and function to block the holes 51 formed in the piston 43. Neck 59 is inserted through aperture 75 as comparatively depicted in FIGS. 12(A), 13(B), and 13(D).

The return spring 45 locates between the piston 43 and the piston-receiving structure 46 within the cavity 50 and is always under some compression to ensure return of certain fluid delivery parts or elements to the starting or original position after a cycle of liquid flow (as at arrows 106) has finished. The ring rib 60 on the piston 43 is used to fix the return spring 45.

Two sides of the valve assembly 47 insert into two short pipes or delivery conduits 48. The valve assembly 47 allows liquid material 40 to flow out from the liquid receptacle 35, but prevents liquid material 40 from flowing back through the conduit or pipeline feature 61. The liquid receptacle 35 is fixed by features formed at or on the inner surfacing 32 of the scrubber structure 23. The funnel like feature 62 of the liquid receptacle 35 aids the user in filling the liquid receptacle with liquid material 40, and the O-ring 85 seats on the round groove between the lower out surface and rib ring 63. Both the O-ring 85 and rib ring feature 63 create interference with the piston-receiving structure 46 to prevent liquid material 40 from leaking.

Figure 11:
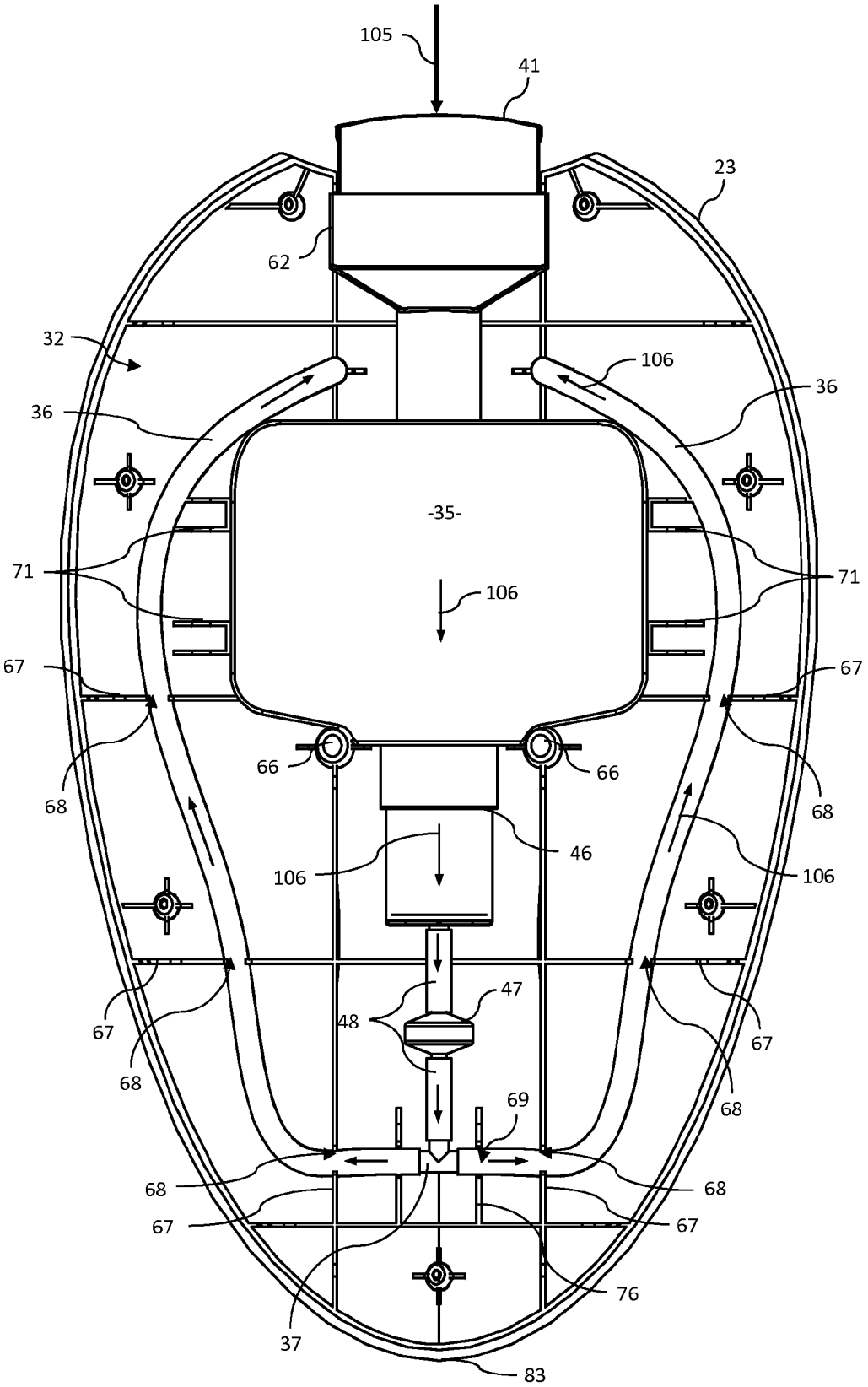
FIG. 11 is a first posterior or rear view of the back-engaging assembly of the wall-mountable back-scrubbing apparatus according to the present invention shown with parts removed to reveal the fluid delivery system of the apparatus.
Figure 16:
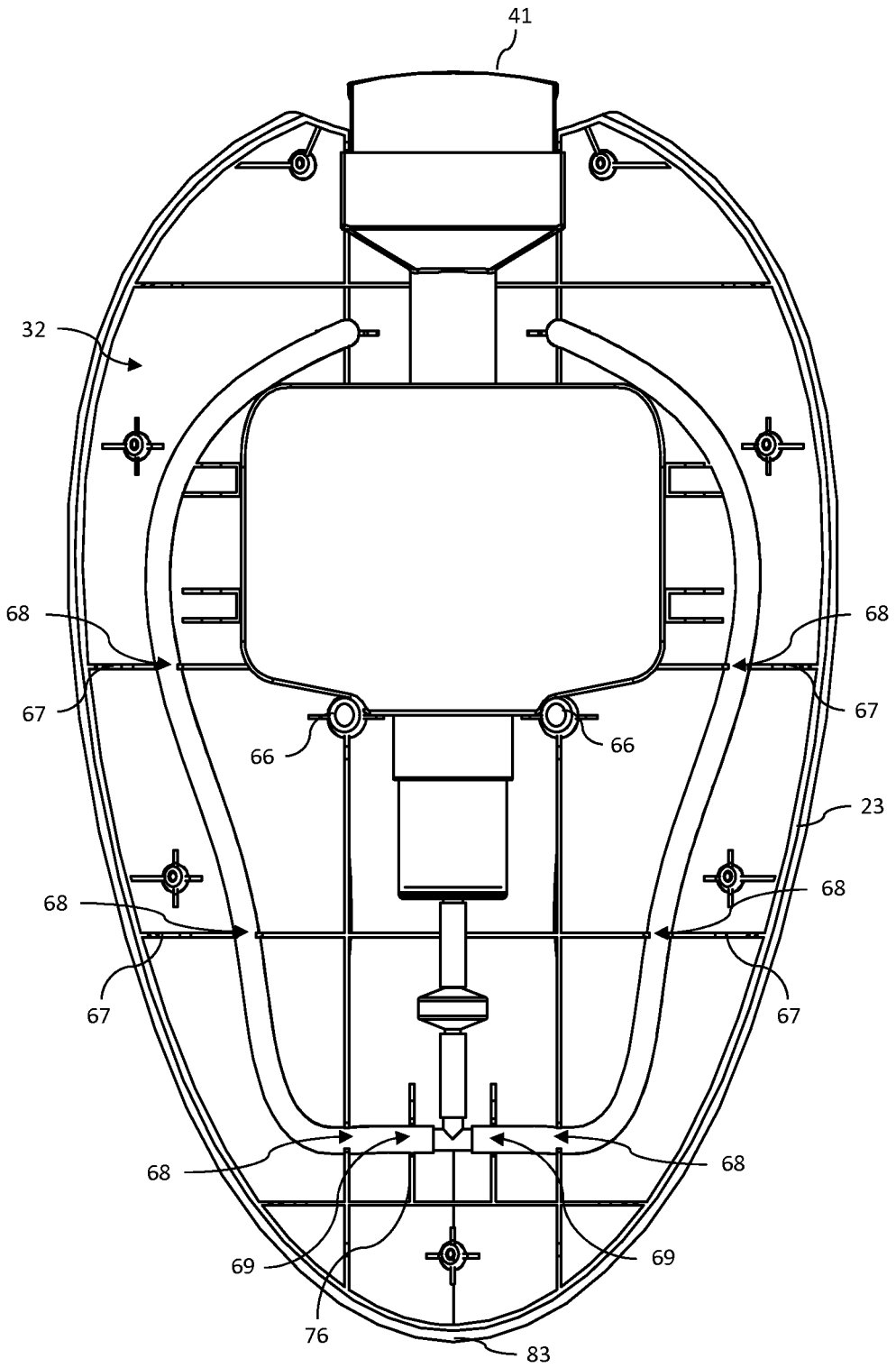
FIG. 16 is a first posterior or rear view of the back-engaging assembly of the wall-mountable back-scrubbing apparatus according to the present invention shown with parts removed to reveal the fluid delivery system of the apparatus.

The backing section 25 is attached to the contoured scrubber structure 23 for enclosing the liquid delivery assembly 24 within the cavity 70. In this regard, FIGS. 11 and 16 depict a rear or posterior view of the apparatus 10 with the backing section 25 or posterior interface structure 22 removed. Two bosses 66 insert into two X crossing features 86 formed on plate-engaging posterior 22 to datum posterior interface structure 22 and scrubber structure 23. The bosses 66 are the primary fastening points between the contoured scrubber structure 23 and the backing section 25, the fastening hardware not being specifically illustrated.

The bosses 66 further sustain or support the liquid receptacle 35, and balance the spring force of the return spring 45. Each rib 67 preferably comprises slots as at 68 to fix the laterally opposed liquid delivery conduit 36. Two further slot formations as at 69 formed in ribbing 76 fix the T-junction liquid delivery conduit 37. Two sides of block structures 71 control horizontal movement of the conduit 36 and liquid receptacle 35.

The wall-mountable slider plate 13 is fastened to the wall 11 via the fastening means 17 as exemplified by the indicated command strips. When the back-engaging assembly 14 is assembled to the slider plate 13, the medially extending pivot pins 27 are received in the laterally open pin-receiving grooves 18; the laterally extending block structures 20 are received in the medially open block-receiving grooves 28; and the forwardly extending teeth 21 mesh with the rearwardly extending teeth 29.

The back-engaging assembly 14 is vertically re-positionable by (1) pivoting the back-engaging assembly 14 via the pivot pins 27 thereby disengaging the meshed forwardly and rearwardly extending teeth 21 and 29, (2) adjusting the back-engaging assembly 14 vertically relative to the wall-mountable slider plate 13, the pivot pins 27 and block structures 20 vertically and respectively traveling in the pin-receiving grooves 18 and block-receiving grooves 28, and (3) re-pivoting the back-engaging assembly 14 via the pivot pins 27 thereby engaging or meshing the forwardly and rearwardly extending teeth 21 and 29.

Figure 8:
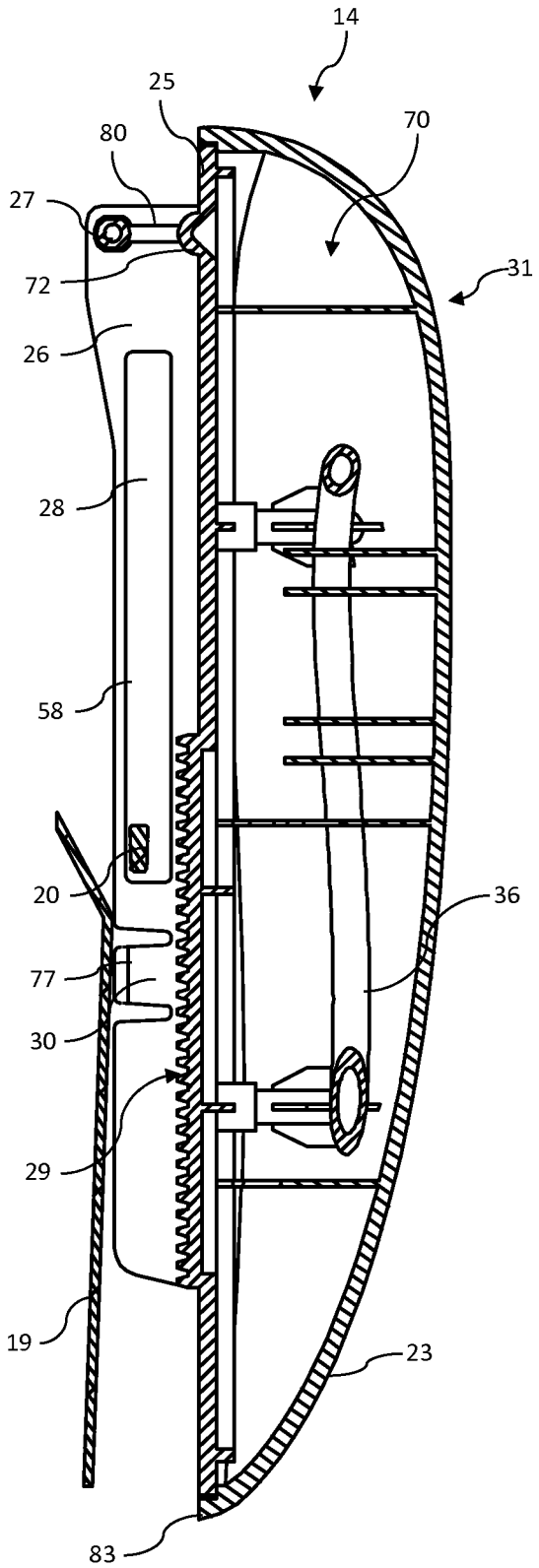
FIG. 8 is a lateral longitudinal cross-sectional view of the back-engaging assembly of the wall-mountable back-scrubbing apparatus according to the present invention, the apparatus being shown juxtaposed adjacent a rib guide of the slider plate in the fully elevated, open state.

Referencing FIG. 8, the reader will note a fragmentary right lateral sectional view of the apparatus 10 in an opened (ready to vertically re-position) state. The main body or back-engaging assembly 14 is shown in a superior position relative to the guide rib 19 (of the slider plate 13). The block structure 20 is received in the rectangular block-receiving groove 28. Given the relatively greater width of the groove 28 relative to the block structure 20, the user can only pivot the back-engaging assembly 14 a limited angle since the surface or wall 58 provides stop structure to the block structure 20 during pivotal movement.

The assembly-to-plate locking means as exemplified by the resilient chamfered snap or tab structures 30 in cooperative engagement with the rib guides 19 prevent pivot rotation about the pivot pins 27 for maintaining the back-engaging assembly 14 in a selectively vertical fixed position relative to the wall-mountable slider plate 13. In this regard, the tab structures 30 each preferably comprise a rib-engaging flange as at 77, which flanges 77 engage the guide ribs 19.

The tab structures 30 resiliently displace laterally (not specifically illustrated) during opening and closing events, and the flanges 77 provide stop structure relative to the ribs 19 when the tabs 30 are in a relaxed (closed or open) state. Manual force during pivotal action actuates the tabs 30, and a "pa" sound may be heard when the flanges pass the plane of the wall portion of structures 26. Bottom groove walls 78 of the pin-receiving grooves 18 provide stop structure for the pins 27 thereby limiting the lowest vertical displacement of the back-engaging assembly 14 relative to the slider plate 13.

FIG. 1 depicts the apparatus 10 in a closed state and vertically positioned at its highest elevation for taller users. A taller user may thus scrub his or her back 12 with the apparatus 10 in this highest elevation, and a liquid material 40 such as body wash or soap will flow out from the scrubber holes or section apertures 34 when the manually operable button cap 41 is depressed or forced in a downward direction as at vector 105.

Figure 2:
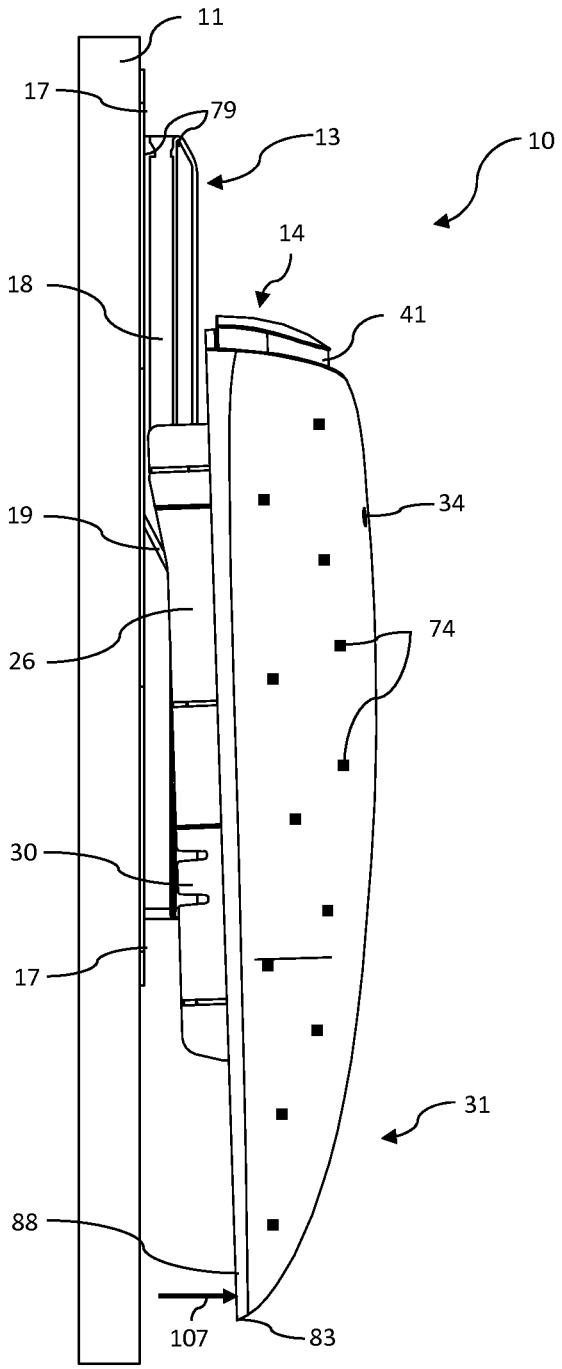
FIG. 2 is a lateral view of a preferred embodiment of the wall-mountable back-scrubbing apparatus according to the present invention shown mounted to a fragmentary wall, the apparatus being shown in a fully lowered, open state.
Figure 3:
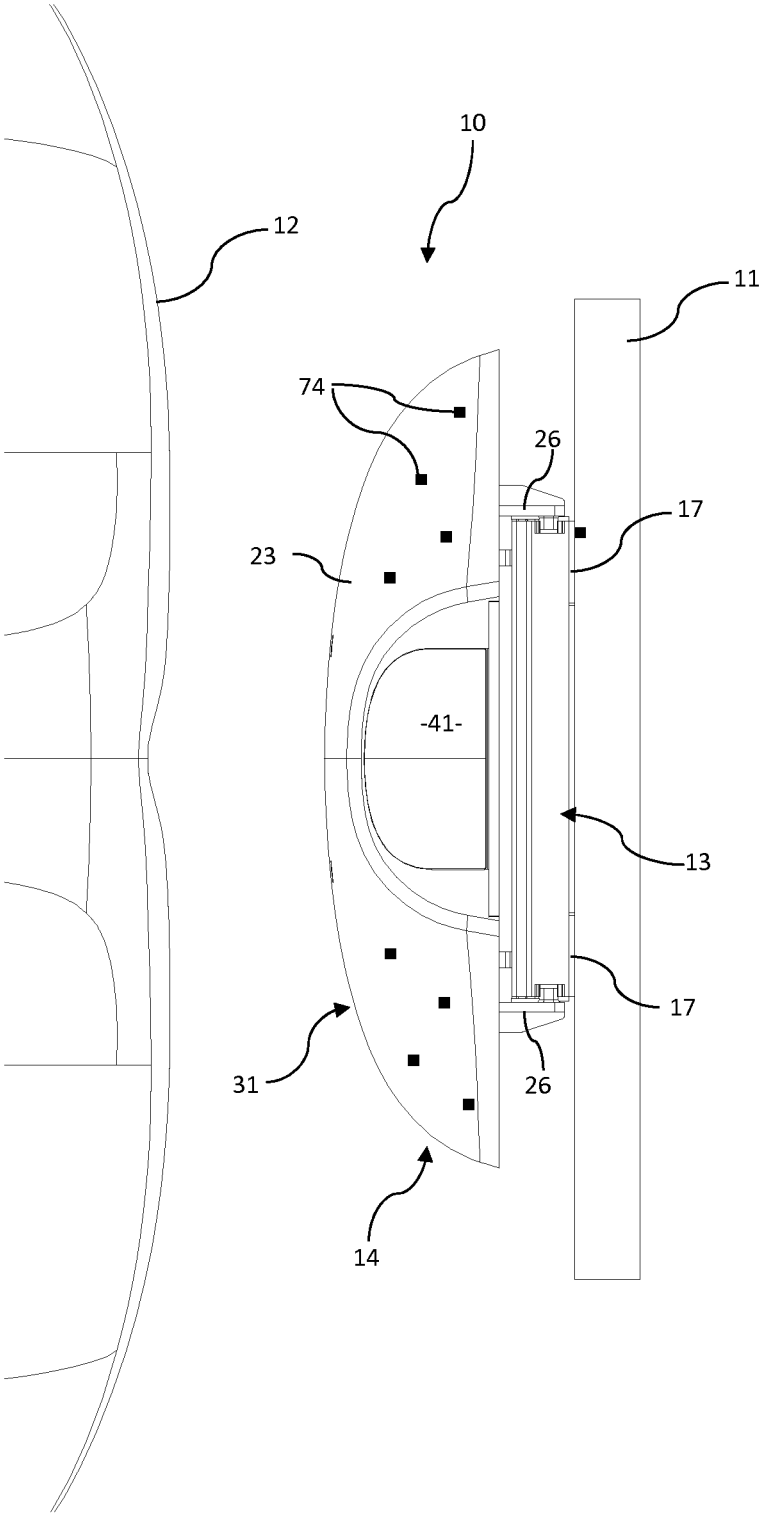
FIG. 3 is a first top end view of a preferred embodiment of the wall-mountable back-scrubbing apparatus according to the present invention shown mounted to a fragmentary wall and juxtaposed medially adjacent a fragmentary back of a user.
Figure 4:
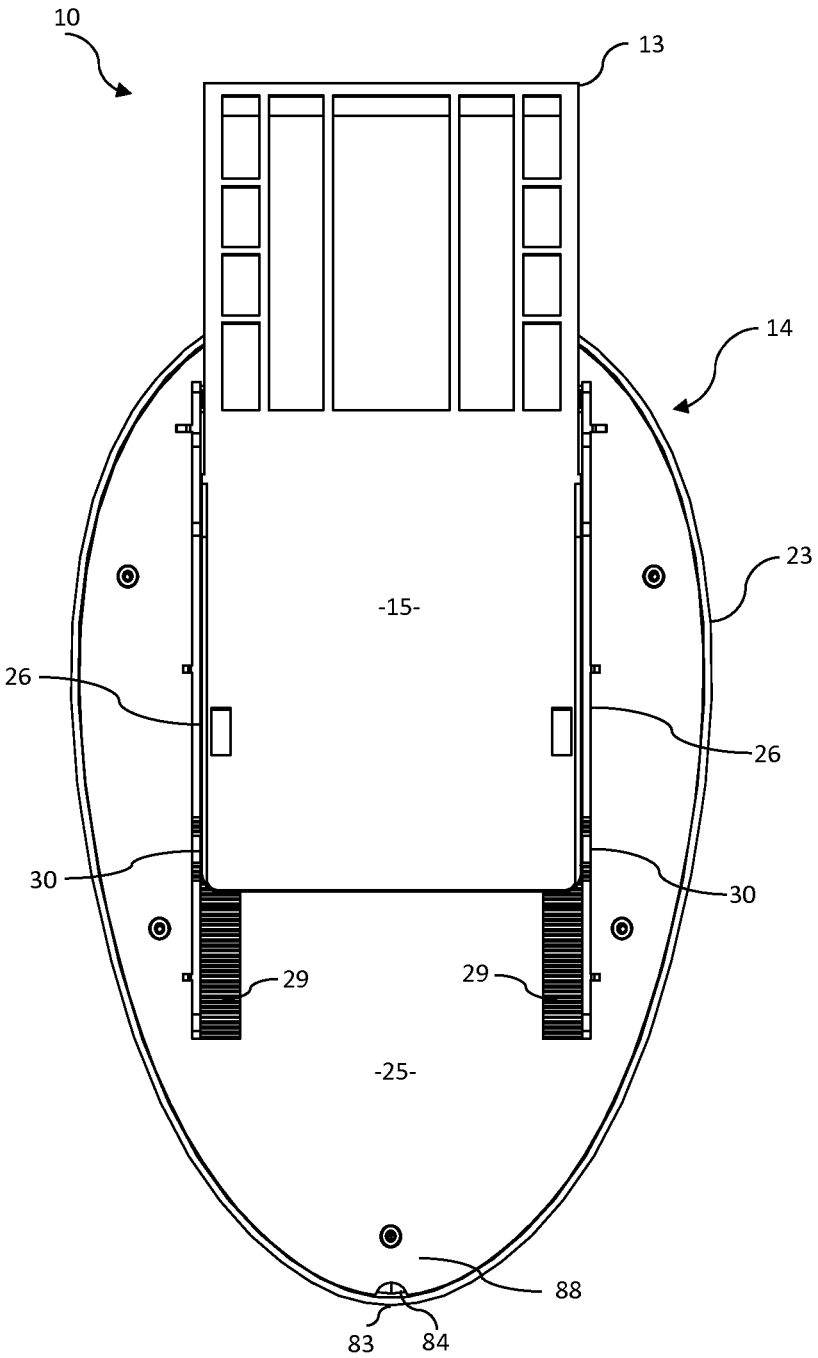
FIG. 4 is a back or posterior view of a preferred embodiment of the wall-mountable back-scrubbing apparatus according to the present invention, the apparatus being shown in a fully lowered, open state.

In contrast to FIG. 1, FIG. 2 shows the apparatus 10 in an open state and the lowest vertical displacement of the back-engaging assembly 14 relative to the slider plate 13. The main body or back-engaging assembly 14 when in locked engagement with slider plate 13 is released by forcing the lower handle area 88 in an anterior direction as at vector 107.

Once released from the closed position in to the open position, the user can vertically re-position the back-engaging assembly 14 relative to the slider plate 13 with a certain angle enabled by the pins 27 and block structures 20 as received in pin-receiving and block-receiving grooves 18 and 28. Rib stops 79 are located at the superior end of the grooves 18 to provide stop structure for the pins 27 and limit the highest vertical displacement of the back-engaging assembly 14 relative to the slider plate 13.

Figure 5:
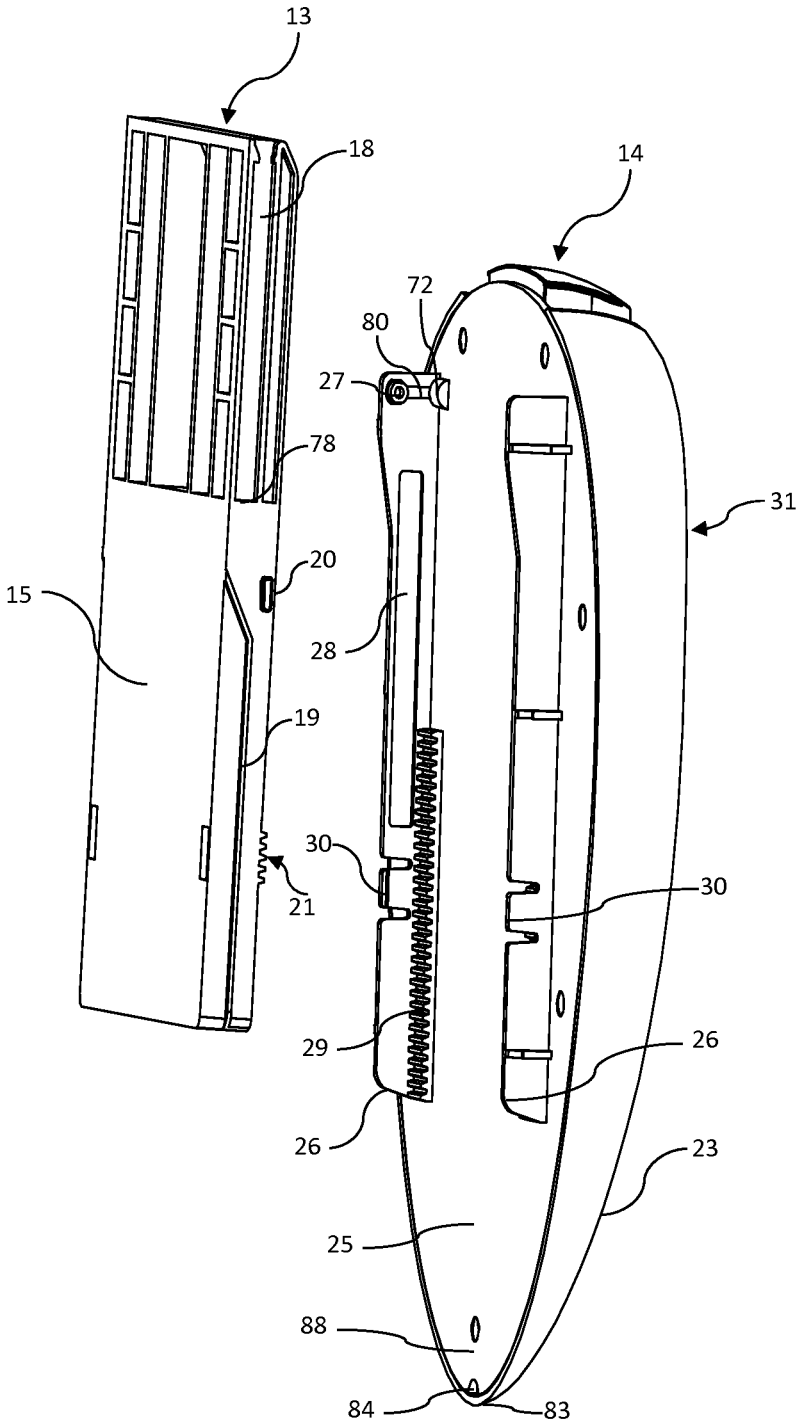
FIG. 5 is a back or posterior exploded perspective view of a preferred embodiment of the wall-mountable back-scrubbing apparatus according to the present invention, the back-engaging assembly being shown exploded from the slider plate.

Referencing FIG. 5, the reader will note that the (e.g. five) forwardly extending teeth 21 on the slide plate mesh with the rearwardly extending teeth (or racks) 29 of the back-engaging assembly 14. The minimum height adjustment is the distance traveled by one tooth (21 or 29) width. In a typical vertical re-position, each movement or adjustment will involve several teeth advancement.

The block structures 20 are preferably inserted into the block-receiving grooves to prevent the user from damaging the product with excessive force as at 107. Ribs at 80 are included to minimize the top/higher and guide ribs 19 minimize the bottom/lower horizontally directed displacements of the back-engaging assembly 14 relative to the slider plate 13. Half cylinder bosses 72 function to absorb pressures or forced from the user and will provide stop structure for the anterior slider surface 16 when in use.

Figure 7:
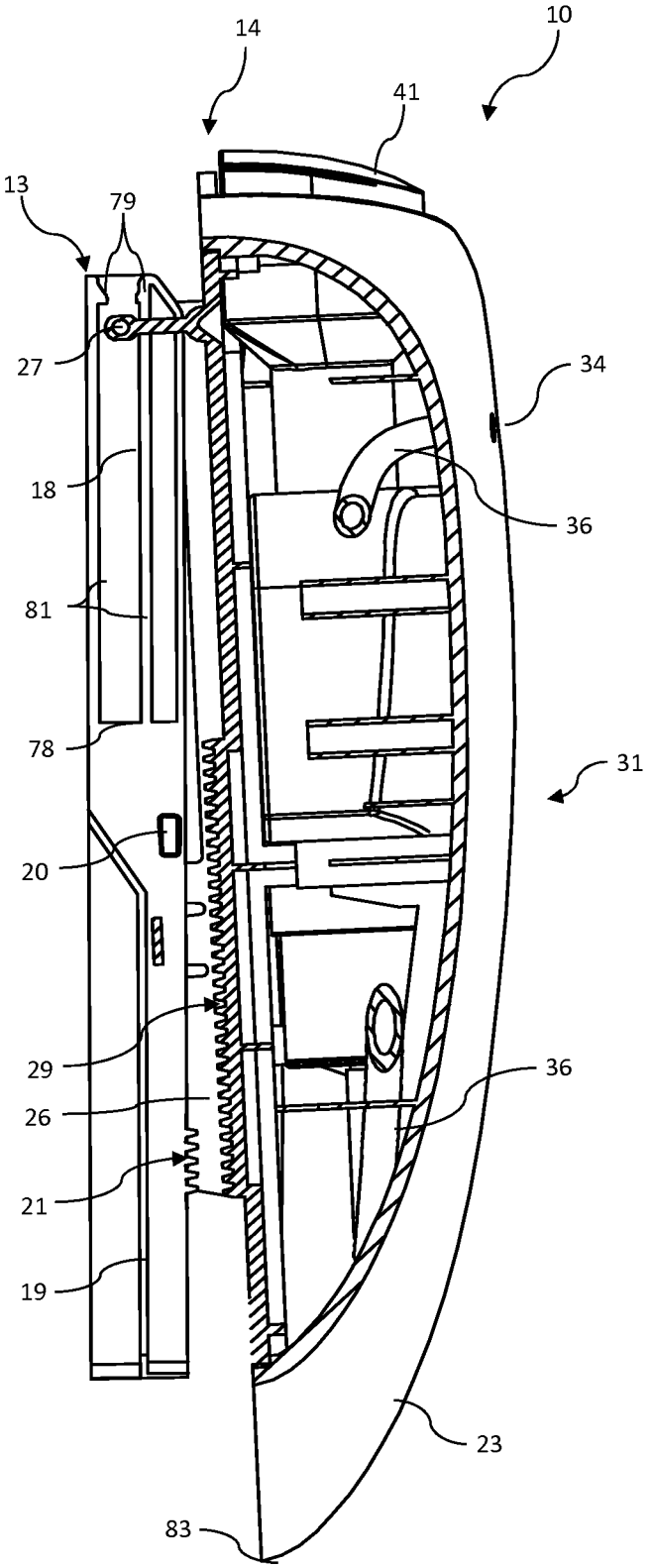
FIG. 7 is a lateral view of a preferred embodiment of the wall-mountable back-scrubbing apparatus according to the present invention with parts of the apparatus broken away to depict inner working elements, the apparatus being shown in a fully elevated, open state.

Referencing FIG. 7, the pivot pins 27 as received in the pin-receiving grooves 18 bound by both groove walls 81 and half cylinder bosses 72 provide stop structure for the pins 27 in anterior and posterior directions, and thus help guide vertical movement. The half cylinder bosses 72 withstand pressure at the upper half of the apparatus 10 in the anterior-posterior horizontal direction; the anterior surfaces of teeth 21 and posterior surfaces of teeth 29 withstand pressure at the lower half of the apparatus 10, and meshed teeth 21 and 29 resist forces in the vertical direction.

Figure 9:
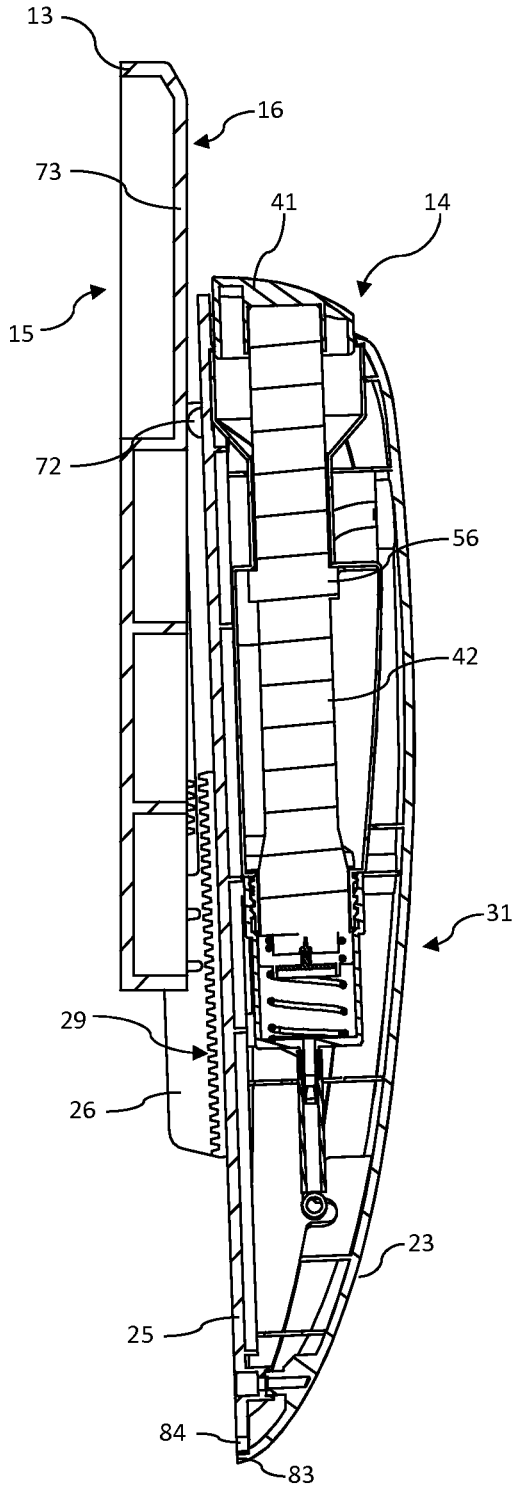
FIG. 9 is a lateral longitudinal cross-sectional view of the wall-mountable back-scrubbing apparatus according to the present invention, the apparatus being shown in the fully lowered, open state.

Referencing FIG. 9, the reader will note that the main body or back-engaging assembly 14 is at the lowest vertical elevation in an open state and at the largest pivot angle enabled by the pertinent structures. The half cylinder bosses 72 are in engagement with the slider flat surface 73, and the forwardly extending teeth 21 and the rearwardly extending teeth are unengaged, thereby enabling the back-engaging assembly 14 to be re-positioned vertically (upwardly) when the back-engaging assembly 14 is so angled.

Referencing FIGS. 1, 2, 3, and 15, for example, the reader will note preferred protuberant grain texture 74 formed upon the surfacing 31. The protuberant grain texture 74 helps ensure that a bath towel or cloth cover 82 can fix on the contoured scrubber structure 23, and prevent the same from displacing along the contour of the surfacing 31 during use. The shape of bath towel cover 82 is similar to the profile of the apparatus 10, and the towel or cloth cover 82 covers the entire scrubber structure 23 with some overlaps at the backing section 25.

The bath towel or cover 82 is preferably formed from a material that has a relatively rough texture so that it can help to clean the back more efficiently and comfortably. The liquid material 40 such as soap or body wash is outlet from the apertures 34 and will wet the cover 82, and the user can scrub his or her own back 12 via the soap-drenched cover 82. The bath cover 82 will cover all the front contour of the scrubber structure 23, and have some excess overlap material as at 83 to cover the back edges all around to prevent it from dropping out. The hook like ring 87 on the top of cover 82 can differentiate up or down side and enhance the convenience of hanging. An elastic rope (not specifically illustrated) may be further included to tie up the cover to ensure that the bath cover 82 will always follow contour of apparatus 10 without becoming deformed relative thereto.

In use, the user may depress the button cap 41, thereby forcing liquid material 40 such as body wash or soap from the outlets 34. Once the liquid material exits the outlets 34, the surfacing 31 of the contoured scrubber structure 23 directs the liquid material 40 under gravitational force in a downward and posterior direction as at arrows 108 in FIG. 1. When a user engages the apparatus 10 (as preferably outfitted with cloth cover 82) with his or her back 12, the liquid material 40 may become laterally displaced relative to the outlets 34.

In this case, the liquid material 40 then migrates downwardly and medially as generally depicted at arrows 109 in FIG. 10. When liquid material 40 reaches the lowest point of the hemi-ovoidal shape as at 83, the liquid material generally departs the apparatus 10 and moves in straight downward direction as at vector 110. The hemi-ovoidal shape of the scrubber structure 23 thus functions to both ergonomically engage the user's back 12, and direct moisture to a single point as at 83 of the scrubber structure 23 before it departs the apparatus 10 and directs straight downward as at vector 110. An aperture 84 just above lowest point 83 outlets liquid material 40 that may have collected inside the back-engaging assembly 14 so that it may combine with other liquid material departing the apparatus from point 83.

Figure 17:
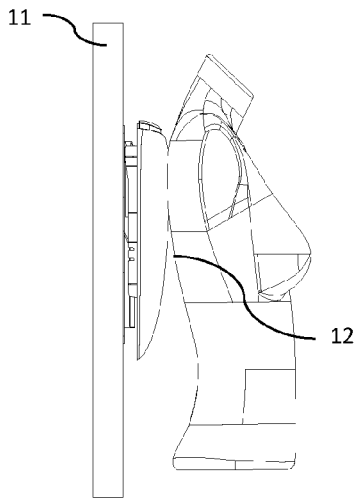
FIG. 17 is a first lateral view of the apparatus according to the present invention shown in a manner of use intermediate a fragmentary wall and human torso, the apparatus being shown at a first elevation relative to the user.

FIG. 17 generally depicts the apparatus 10 adhesively and preferably attached to a wall 11 by four double-sided adhesive strips sold under the registered brands 3M® and COMMAND® by the 3M Company, a Delaware corporation with current business address of 2501 Hudson Road, St. Paul, Minn., 55144. The surfacing of a human back 12 can better engage the unique hemi-ovoidal contour of the scrubber structure 23 as the human spine area comprises a generally concave contour and the convex shape of apparatus 10 can better engage in this area. This type of engagement can always provide the largest surface contact area for better scrubbing vertically (up and down) and laterally (left and right).

Figure 18:
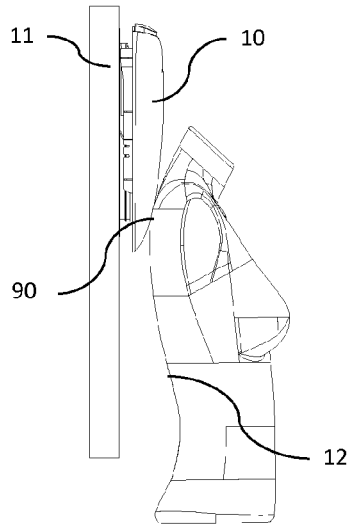
FIG. 18 is a second lateral view of the apparatus according to the present invention shown in a manner of use intermediate a fragmentary wall and human torso, the apparatus being shown at a second elevation relative to the user, the second elevation being greater than the first elevation.
Figure 19:
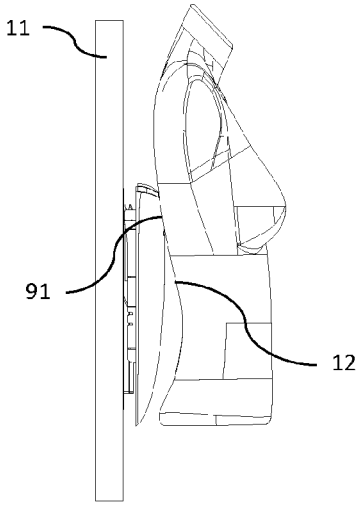
FIG. 19 is a third lateral view of the apparatus according to the present invention shown in a manner of use intermediate a fragmentary wall and human torso, the apparatus being shown at a third elevation relative to the user, the third elevation being lesser than the first elevation.

FIG. 18 depicts the apparatus 10 in a vertically elevated state relative to the user's back 12. By adjusting the assembly main body or back-engaging assembly 14 to its highest point relative to the slider plate 13, the lower side 90 of the apparatus 10 can scrub the back surfacing adjacent the human shoulders, where there is a generally concave shape. FIG. 19 depicts the apparatus 10 in a vertically lowered state relative to the user's back 12. By adjusting the assembly main body or back-engaging assembly 14 to its lowest point relative to the slider plate 13, the higher side 91 of the apparatus 10 can scrub the lower area of the human back surfacing, where there is a generally concave shape.

Figure 20:
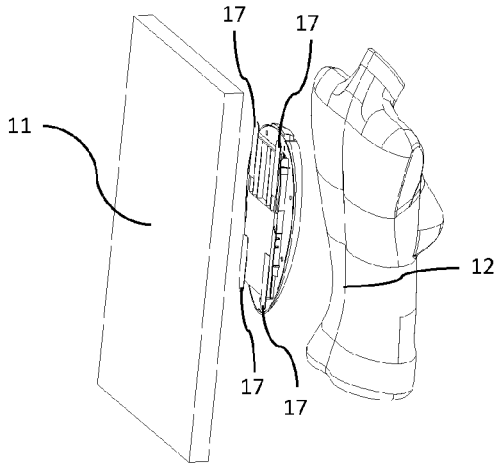
FIG. 20 is a posterior or rear exploded perspective view of the apparatus according to the present invention shown in exploded intermediate a fragmentary wall and human torso.

FIG. 20 depicts a rear perspective exploded type view of a fragmentary wall 11, apparatus 10, and human back 12. The surfacing of the human back 12 can engage the apparatus 10 very easily, the concave contours of the human back 12 engage the convex shape of the scrubber structure 23 in a more cooperable manner. A first side of the double-sided adhesive strips 17 adhere to the back surfacing 15 of the slider plate 13, and a second side of the double-sided adhesive strips 17 adhere to the wall 11.

Figure 21:
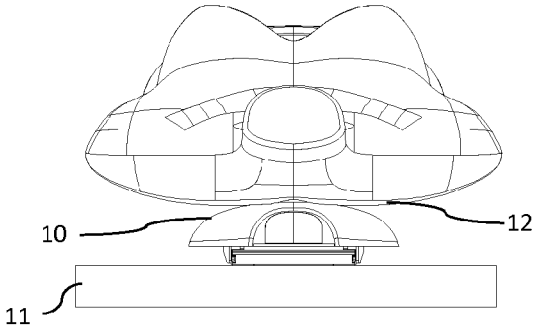
FIG. 21 is a second top end view of a preferred embodiment of the wall-mountable back-scrubbing apparatus according to the present invention shown mounted to a fragmentary wall shown in cross-section and juxtaposed medially adjacent a human torso.
Figure 22:
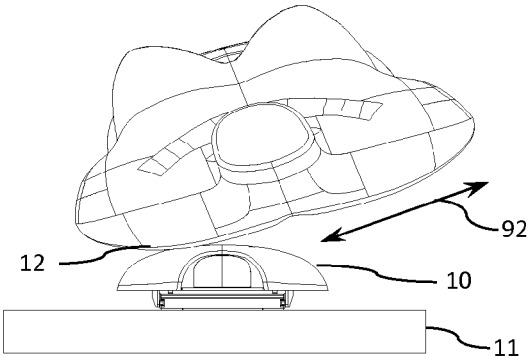
FIG. 22 is a third top end view of a preferred embodiment of the wall-mountable back-scrubbing apparatus according to the present invention shown mounted to a fragmentary wall shown in cross-section and juxtaposed laterally adjacent a human torso.

FIG. 21 depicts a top view of the apparatus adjacent a fragmentary human torso. The convex shape of the scrubber structure 23 more precisely matches the concave contour of human back 12. The device or apparatus 10 contact surface 31 can cover the most surface area of the human back 12, including the spinal areas and lateral back areas. FIG. 22, for example, further depicts a top view of the apparatus 10 when the user is scrubbing left lateral portions of the human back 12. The user can scrub the main part and the edges of back by swinging his or her body left and right repeatedly as arrows 92 shows.

Figure 23:
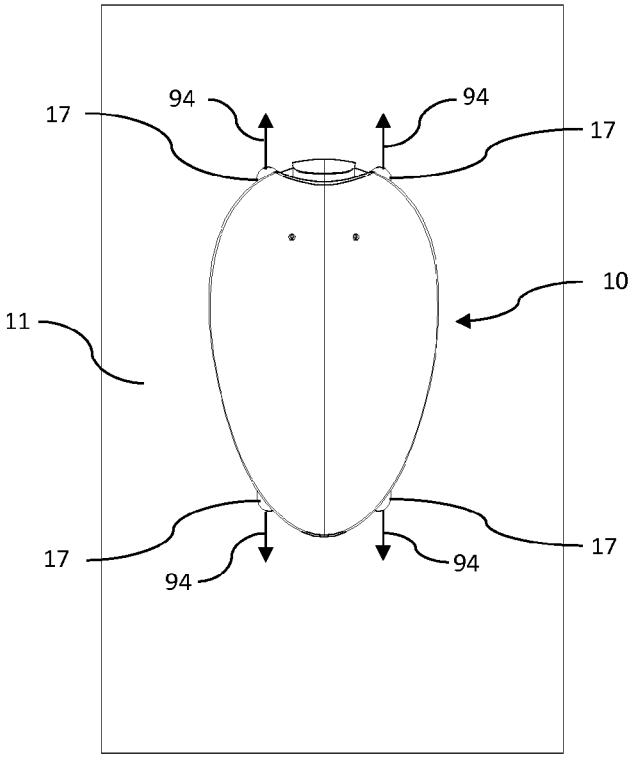
FIG. 23 is an anterior of frontal view of the apparatus according to the present invention shown mounted to a fragmentary wall and depicting vector arrows to represent pull forces for removing the apparatus from adhesive engagement with the wall.

FIG. 23 shows the apparatus 10 being dismounted from a wall 11. To remove the apparatus 10 from the wall 11, the user should pull (as at arrows 94) the adhesive strips 17 slowly in a vertical direction until each strip 17 separates from the wall 11 and apparatus 10. Adhesively attaching new strips 17 to the apparatus 10 enables the user to re-attach the apparatus 10 to the wall 11.

While the foregoing specifications set forth much specificity, the same should not be construed as setting forth limits to the invention but rather as setting forth certain preferred embodiments and features. For example, it is contemplated that the cooperative association of the rib guides 19 and the tabs 30 may very well be considered as providing certain apparatus-to-plate fastening means for selectively preventing pivot rotation about the pivot pins and for maintaining the back-engaging assembly in a selective vertically fixed position relative to the slider plate.

Further, it is contemplated that the fluid delivery means of the fluid delivery assembly may be exemplified by the elements generally described hereinabove under the pertinent specifications. Accordingly, although the invention has been described by reference to certain preferred and alternative embodiments, it is not intended that the novel arrangements be limited thereby, but that modifications thereof are intended to be included as falling within the broad scope and spirit of the foregoing disclosures and the appended drawings.

We claim:

1. A wall-mountable apparatus for enabling a user to scrub the user's back hands-free, the wall-mountable apparatus comprising:

a wall-mountable slider plate, the slider plate comprising a maximum plate width, a maximum plate height, a wall-engaging posterior side, an assembly-engaging anterior side, and laterally opposed plate-to-assembly engaging structures, the wall-engaging posterior side being outfittable with plate-to-wall fastening means, the laterally opposed plate-to-assembly engaging structures each comprising laterally-located structures and anteriorly-located structures, the laterally-located structures comprising an upper pin-receiving groove, the anterior located structures comprising forwardly-extending teeth; and a back-engaging assembly, the back-engaging assembly comprising a plate-engaging interface structure, a back-engaging scrubber structure, and a liquid material delivery assembly, the plate-engaging interface structure comprising a backing section and laterally-opposed plate-engaging structures, the laterally-opposed plate-engaging structures having a uniform distance therebetween, the uniform distance being greater than the maximum plate width, each plate-engaging structure comprising an upper medially extending pivot pin and rearwardly extending teeth, the scrubber structure comprising an anterior outer surface, lateral sides, and an assembly-receiving inner surface, the anterior outer surface and assembly-receiving inner surface comprising at least one liquid outlet, the liquid material delivery assembly being receivable adjacent the assembly-receiving inner surface and comprising a liquid receptacle and liquid delivery means, the liquid delivery means being in communication with the at least one liquid outlet for outletting liquid material from the liquid receptacle to the anterior outer surface, the backing section being attached to the scrubber structure for enclosing the liquid material delivery assembly therewithin, the slider plate being fastenable to a wall, the pivot pins being received in the pin-receiving grooves, the forwardly extending teeth being engaged with the rearwardly extending teeth, the back-engaging assembly being vertically re-positionable relative to the slider plate by (1) pivoting the back-engaging assembly via the pivot pins thereby disengaging the forwardly and rearwardly extending teeth, (2) adjusting the back-engaging assembly vertically relative to the slider plate, the pivot pins vertically traveling in the pin-receiving grooves, and (3) re-pivoting the back-engaging assembly via the pivot pins thereby re-engaging the forwardly and rearwardly extending teeth, the anterior outer surface and lateral sides of the scrubber structure for directing liquid material downward, rearward and medially to a maximum low point of the scrubber structure for enabling the liquid material to depart the scrubber structure from the maximum low point.

2. The wall-mountable apparatus of claim 1 comprising a cover, the cover being constructed from a washable fabric and being outfittable at least upon the anterior outer surface for providing a washable fabric interface intermediate the user's back and the anterior outer surface.

3. The wall-mountable apparatus of claim 2 wherein the anterior outer surface comprises protuberant grain texturing, the protuberant grain texturing for preventing the cover from displacements relative the anterior outer surface.

4. The wall-mountable apparatus of claim 1 wherein the liquid delivery means of the liquid material delivery assembly comprises a piston shaft, the piston shaft comprising a cross-shaped transverse cross section, the cross-shaped transverse cross section for increasing volumetric space for receiving liquid material and for decreasing fill time of the liquid receptacle.

5. The wall-mountable apparatus of claim 1 wherein the laterally-located structures of the slider plate each comprise a laterally-extending block structure, and wherein the laterally-opposed plate-engaging structures of the back-engaging assembly each comprise a block-receiving groove, the block structures being receivable in the block-receiving grooves, the block structures travelling in the block-receiving grooves when adjusting the back-engaging assembly vertically relative to the slider plate.

6. The wall-mountable apparatus of claim 1 wherein the liquid delivery means comprise laterally opposed liquid conduit and a T-junction liquid conduit in communication therewith, the T-junction liquid conduit comprising a single liquid inlet and laterally-opposed conduit-engaging liquid outlets, the laterally-opposed conduit being in communication with the laterally-opposed conduit-engaging liquid outlets for delivering liquid material from the T-junction liquid conduit to the at least one liquid outlet.

7. The wall-mountable apparatus of claim 1 wherein the plate-engaging structures of the back-engaging assembly further comprise laterally opposed resilient tab structures and the laterally-located structures of the slider plate further comprise laterally extending guide ribs, the tab structures being resiliently deformable for selectively unlocking and locking the back-engaging assembly relative to the guide ribs of the slider plate.

8. A wall-mountable apparatus for enabling hands-free back-scrubbing, the wall-mountable apparatus comprising:

a wall-mountable slider plate, the slider plate comprising laterally-opposed plate-to-assembly engaging structures, the laterally-opposed plate-to-assembly engaging structures each comprising an upper pin-receiving groove and forwardly-extending teeth; and a back-engaging assembly, the back-engaging assembly comprising a plate-engaging interface structure and a back-engaging scrubber structure, the plate-engaging interface structure comprising laterally-opposed plate-engaging structures, each plate-engaging structure comprising a medially-extending pivot pin and rearwardly extending teeth, the scrubber structure comprising an anterior surface and lateral sides, the slider plate being fastenable to a wall, the pivot pins being received in the pin-receiving grooves, the forwardly extending teeth being engaged with the rearwardly extending teeth, the back-engaging assembly being vertically re-positionable relative to the slider plate by (1) pivoting the back-engaging assembly via the pivot pins thereby disengaging the forwardly and rearwardly extending teeth, (2) adjusting the back-engaging assembly vertically relative to the slider plate, the pivot pins vertically traveling in the pin-receiving grooves, and (3) re-pivoting the back-engaging assembly via the pivot pins thereby re-engaging the forwardly and rearwardly extending teeth, the anterior surface and lateral sides of the scrubber structure for directing liquid material downward, rearward and medially to a maximum low point of the scrubber structure for enabling the liquid material to depart the scrubber structure from the maximum low point.

9. The wall-mountable apparatus of claim 8 comprising a liquid material delivery assembly, the liquid material delivery assembly being housed within the back-engaging assembly, the anterior surface comprising at least one liquid outlet, the liquid material delivery assembly comprising a liquid receptacle and liquid delivery means, the liquid delivery means being in communication with the at least one liquid outlet for outletting liquid material from the liquid receptacle to the anterior surface.

10. The wall-mountable apparatus of claim 9 wherein the liquid delivery means of the liquid material delivery assembly comprises a piston shaft, the piston shaft comprising a cross-shaped transverse cross section, the cross-shaped transverse cross section for increasing volumetric space for receiving liquid material and for decreasing fill time of the liquid receptacle.

11. The wall-mountable apparatus of claim 8 comprising, in combination a cover outfittable upon the anterior surface, the anterior surface comprising protuberant grain texturing, the protuberant grain texturing for preventing the cover from displacements relative the anterior surface.

12. The wall-mountable apparatus of claim 8 wherein the slider plate comprises laterally-opposed block structures and the back-engaging assembly comprises laterally opposed block-receiving grooves, the block structures being receivable in the block-receiving grooves, the block structures travelling in the block-receiving grooves when adjusting the back-engaging assembly vertically relative to the slider plate.

13. The wall-mountable apparatus of claim 8 comprising (a) means for selectively preventing pivot rotation about the pivot pins and (b) means for maintaining the back-engaging assembly in a selective vertically fixed position relative to the slider plate.

14. The wall-mountable apparatus of claim 13 wherein said means are defined by the cooperative association of (a) resilient tab structures formed upon the plate-engaging structures of the back-engaging assembly, and (b) guide ribs formed upon the slider plate, the tab structures being resiliently deformable for selectively unlocking and locking the back-engaging assembly relative to the guide ribs of the slider plate.

15. A wall-mountable apparatus for enabling hands-free back-scrubbing, the wall-mountable apparatus comprising:

a wall-mountable slider plate, the slider plate comprising laterally-opposed plate-to-assembly engaging structures, the laterally-opposed plate-to-assembly engaging structures each comprising an upper pin-receiving groove and forwardly-extending teeth; and a back-engaging assembly, the back-engaging assembly comprising a plate-engaging interface structure and a back-engaging scrubber structure, the scrubber structure comprising an anterior outer surface, the plate-engaging interface structure comprising laterally-opposed plate-engaging structures, each plate-engaging structure comprising a medially-extending pivot pin and rearwardly extending teeth, the pivot pins being receivable in the pin-receiving grooves, the forwardly extending teeth being engageable with the rearwardly extending teeth, the anterior outer surface of the scrubber structure for directing liquid material.

16. The wall-mountable apparatus of claim 15 comprising a liquid material delivery assembly, the anterior outer surface comprising at least one liquid outlet, the liquid material delivery assembly comprising a liquid receptacle and liquid delivery means, the liquid delivery means being in communication with the at least one liquid outlet for outletting liquid material from the liquid receptacle to the anterior outer surface.

17. The wall-mountable apparatus of claim 16 wherein the liquid material delivery assembly comprises a combination button-cap, the combination button-cap providing (a) means for manually operating the liquid material delivery assembly and (b) means for capping a liquid receptacle of the liquid material delivery assembly.

18. The wall-mountable apparatus of claim 17 wherein the liquid receptacle of the liquid material delivery assembly is defined by a piston shaft, the piston shaft comprising a cross-shaped transverse cross section, the cross-shaped transverse cross section for (a) increasing volumetric space for receiving liquid material and (b) decreasing fill time of the liquid material delivery assembly.

19. The wall-mountable apparatus of claim 15 wherein the slider plate comprises laterally-opposed block structures and the back-engaging assembly comprises laterally opposed block-receiving grooves, the block structures being receivable in the block-receiving grooves, the block structures travelling in the block-receiving grooves when adjusting the back-engaging assembly vertically relative to the slider plate.

20. The wall-mountable apparatus of claim 15 comprising (a) means for selectively preventing pivot rotation about the pivot pins and (b) means for maintaining the back-engaging assembly in a vertically fixed position relative to the slider plate.

* * * * *